US009335729B2

(12) United States Patent
Abe

(10) Patent No.: US 9,335,729 B2
(45) Date of Patent: May 10, 2016

(54) PHOTOSENSITIVE-BODY CARTRIDGE PROVIDED WITH MEMBER THAT CONTACTS BEARING OF PHOTOSENSITIVE BODY

(71) Applicant: BROTHER KOGYO KABUSHIKI KAISHA, Nagoya-shi, Aichi-ken (JP)

(72) Inventor: Koji Abe, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/669,832

(22) Filed: Mar. 26, 2015

(65) Prior Publication Data

US 2015/0277352 A1 Oct. 1, 2015

(30) Foreign Application Priority Data

Mar. 31, 2014 (JP) ..... 2014-071834

(51) Int. Cl.
*G03G 15/02* (2006.01)
*G03G 21/18* (2006.01)

(52) U.S. Cl.
CPC ..... *G03G 21/1821* (2013.01)

(58) Field of Classification Search
CPC ..... G03G 21/0058; G03G 21/169; G03G 21/1821; G03G 21/1857
See application file for complete search history.

(56) References Cited

U.S. PATENT DOCUMENTS 5,521,693 A 5/1996 Kojima et al.
6,006,056 A 12/1999 Hagiwara et al.
6,999,694 B2 2/2006 Takami
7,003,248 B2 2/2006 Kurotori
7,139,504 B2 11/2006 Yanagida
7,194,228 B2 3/2007 Arimitsu
8,301,054 B2 10/2012 Tanabe
8,306,452 B2 11/2012 Okabe
2003/0059233 A1* 3/2003 Jang et al. ..... 399/167
2004/0052557 A1 3/2004 Fukuta (Continued)

FOREIGN PATENT DOCUMENTS

CN 101916063 A 12/2010
JP H10-143048 A 5/1998

(Continued)

OTHER PUBLICATIONS

Related U.S. patent application as filed, U.S. Appl. No. 14/670,076, filed Mar. 26, 2015.

(Continued)

*Primary Examiner* — Roy Y Yi
(74) *Attorney, Agent, or Firm* — Merchant & Gould P.C.

(57) ABSTRACT

A photosensitive-body cartridge includes a cartridge frame, a photosensitive drum accommodated in the cartridge frame, and a contact member. The photosensitive drum includes: a first rotational shaft extending in a first direction to permit the photosensitive drum to rotate together with the first rotational shaft; a drum body extending in the first direction and having a first end and a second end in the first direction; a pressing member provided on the first end of the drum body and applying pressing force to the drum body toward the second end; and a bearing member provided on the second end of the drum body and receiving the first rotational shaft. The contact member is attachable to the cartridge frame and supported by the cartridge frame. The contact member contacts the bearing member in the first direction by the pressing force.

10 Claims, 14 Drawing Sheets

(56) References Cited

U.S. PATENT DOCUMENTS

| | | | |
|---|---|---|---|
| 2005/0025522 | A1 | 2/2005 | Tsuzuki |
| 2006/0093955 | A1 | 5/2006 | Ohshima |
| 2007/0025766 | A1 | 2/2007 | Kamoshida |
| 2007/0116490 | A1 | 5/2007 | Matsumoto |
| 2007/0147903 | A1 | 6/2007 | Mori |
| 2007/0280715 | A1 | 12/2007 | Mori |
| 2007/0286632 | A1 | 12/2007 | Okabe |
| 2008/0008498 | A1 | 1/2008 | Watanabe |
| 2008/0025753 | A1 | 1/2008 | Yamamoto |
| 2008/0056740 | A1 | 3/2008 | Inukai |
| 2008/0279579 | A1 | 11/2008 | Kuruma |
| 2009/0169235 | A1 | 7/2009 | Kamimura |
| 2010/0104312 | A1 | 4/2010 | Kawai |
| 2010/0135689 | A1 | 6/2010 | Abe |
| 2010/0278571 | A1 | 11/2010 | Abe |
| 2011/0318051 | A1 | 12/2011 | Kamimura |
| 2012/0033981 | A1 | 2/2012 | Fukuta |
| 2012/0121289 | A1 | 5/2012 | Kamimura |
| 2012/0219320 | A1 | 8/2012 | Abe |
| 2013/0051834 | A1 | 2/2013 | Kamimura |
| 2015/0277358 | A1 | 10/2015 | Abe |

FOREIGN PATENT DOCUMENTS

| | | | |
|---|---|---|---|
| JP | 2008-090060 | A | 4/2008 |
| JP | 2011-232518 | A | 11/2011 |
| JP | 2012-225964 | A | 11/2012 |
| JP | 2013-054057 | A | 3/2013 |

OTHER PUBLICATIONS

Office Action issued in related application U.S. Appl. No. 14/670,076 on Sep. 30, 2015.

U.S. Office Action issued in related U.S. Appl. No. 14/670,076, mailed Jan. 14, 2016.

* cited by examiner

1

PHOTOSENSITIVE-BODY CARTRIDGE PROVIDED WITH MEMBER THAT CONTACTS BEARING OF PHOTOSENSITIVE BODY

CROSS REFERENCE TO RELATED APPLICATION

This application claims priority from Japanese Patent Application No. 2014-071834 filed Mar. 31, 2014. The entire content of the priority application is incorporated herein by reference.

TECHNICAL FIELD

The present invention relates to a photosensitive-body cartridge used in an image forming apparatus that employs an electrophotographic system.

BACKGROUND

As a cartridge that is mountable in an image forming apparatus, there is known in the art a photosensitive-body unit that includes a housing and a photosensitive drum. The photosensitive drum is rotatably mounted on support shafts fixed in side parts of the housing (see Japanese Patent Application Publication No. H10-143048, for example).

SUMMARY

In the conventional photosensitive-body unit described above, a pair of flanges is provided one on each axial end of the photosensitive drum. In order to stabilize rotation of the photosensitive drum while fixing the axial position of the photosensitive drum, an endface of one flange is placed in contact with one inner surface of the housing, while a brake member is interposed between an endface of the other flange and the other inner surface of the housing.

When this photosensitive-body unit is driven, the endface of the one flange on the photosensitive drum is pressed against the corresponding inner surface of the housing and slides against this inside surface. Accordingly, the inner surface of the housing may become worn due to continuous abrasion by the flange, potentially worsening the positioning precision of the photosensitive drum in its axial direction.

In view of the foregoing, it is an object of the invention to provide a photosensitive-body cartridge capable of improving the precision in positioning a photosensitive drum while ensuring stable rotation of the same.

In order to attain the above and other objects, there is provided a photosensitive-body cartridge that may include a cartridge frame, a photosensitive drum is accommodated in the cartridge frame, and a contact member. The photosensitive drum includes: a first rotational shaft extending in a first direction, the photosensitive drum being configured to rotate together with the first rotational shaft; a drum body extending in the first direction and having a first end and a second end in the first direction; a pressing member provided on the first end of the drum body and applying pressing force to the drum body toward the second end; and a bearing member provided on the second end of the drum body and receiving the first rotational shaft. The contact member is configured to be attached to the cartridge frame and supported by the cartridge frame, the contact member contacting the bearing member in the first direction by the pressing force.

DETAILED DESCRIPTION

1. Overview of a Drum Cartridge

A drum cartridge 1 according to an embodiment of the invention will be described with reference to FIGS. 1 through 12.

Figure 1:
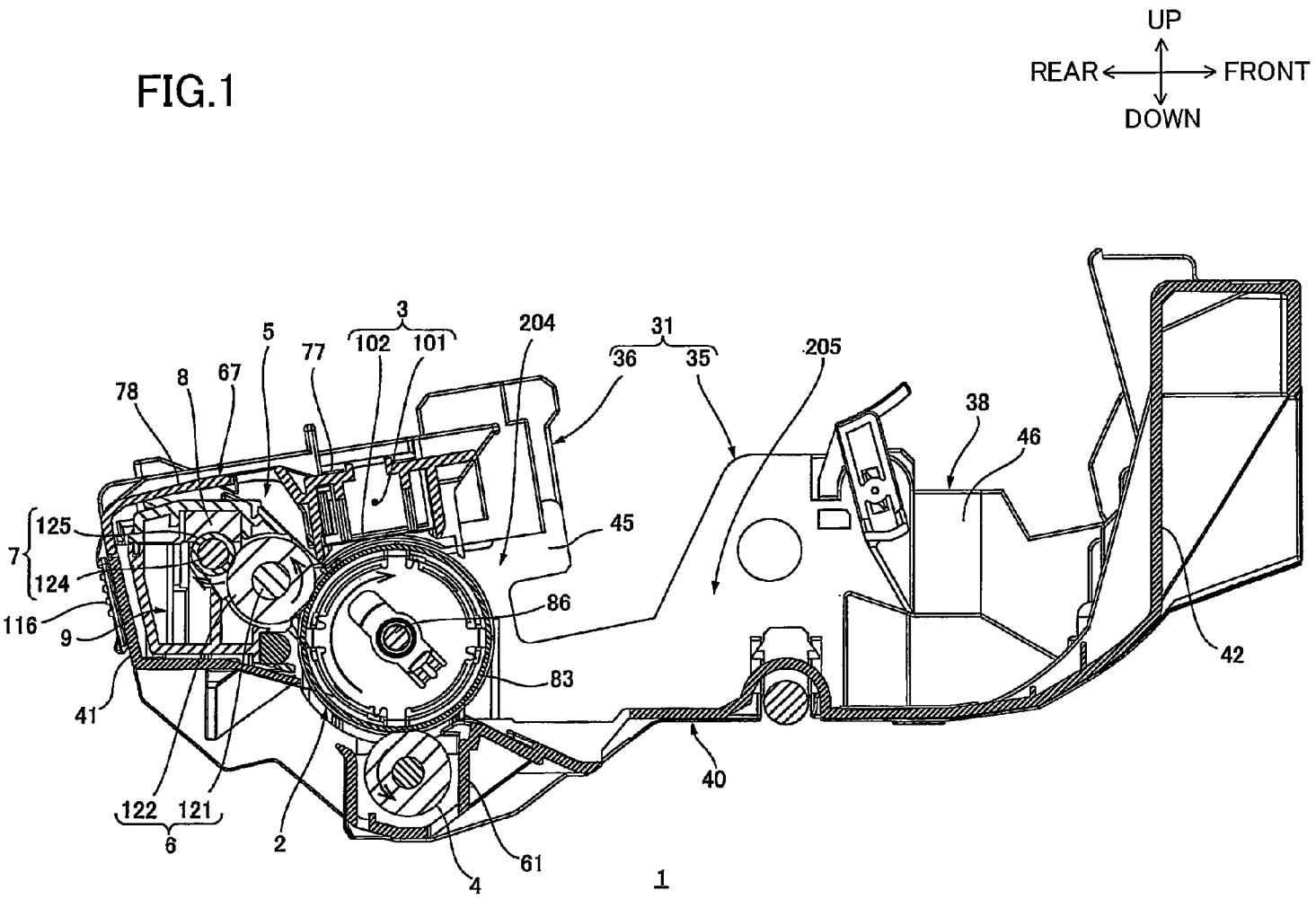
FIG. 1 is a central cross-sectional view of a drum cartridge according to an embodiment of the invention, the drum cartridge including a base frame and a cover frame.

As shown in FIG. 1, the drum cartridge 1 as an example of a photosensitive-body cartridge of the invention has a frame-like structure with a closed bottom and is generally rectangular in a plan view. The drum cartridge 1 includes a photosensitive drum 2 as an example of a photosensitive drum of the invention, a scorotron charger 3 as an example of a charger of the invention, a transfer roller 4, and a cleaning unit 5.

In the following description, when giving directions related to the drum cartridge 1, the side of the drum cartridge 1 in which the photosensitive drum 2 is provided will be called the "rear," while the opposite side of the drum cartridge 1 will be called the "front." Left and right sides of the drum cartridge 1 will be defined based on the perspective of a user facing the front of the drum cartridge 1. Directional arrows have also been provided in the drawings for reference.

The photosensitive drum 2 has a general cylindrical shape with its axis aligned in a left-right direction. The left-right direction is an example of a first direction. The photosensitive drum 2 is rotatably supported in a rear end portion of the drum cartridge 1.

The scorotron charger 3 is disposed above the photosensitive drum 2 but is separated therefrom.

The transfer roller 4 is disposed beneath the photosensitive drum 2 such that a top surface of the transfer roller 4 is in contact with a bottom surface of the photosensitive drum 2.

The cleaning unit 5 is disposed on the rear side of the photosensitive drum 2. The cleaning unit 5 is provided with a primary roller 6 as an example of a cleaning roller in the invention, a secondary roller 7, a sponge scraper 8, and a collection unit 9.

The primary roller 6 is disposed diagonally upward and rearward of the photosensitive drum 2 and is in contact with an upper-rear surface of the same.

The secondary roller 7 is disposed on the upper-rear side of the primary roller 6 and is in contact with an upper-rear surface of the same.

The sponge scraper 8 is disposed above the secondary roller 7 and is in contact with a top surface of the same.

The collection unit 9 has a box-like shape that is open on the upper-front side. The collection unit 9 is disposed beneath the secondary roller 7.

2. Mode of Use for the Drum Cartridge

Figure 2:
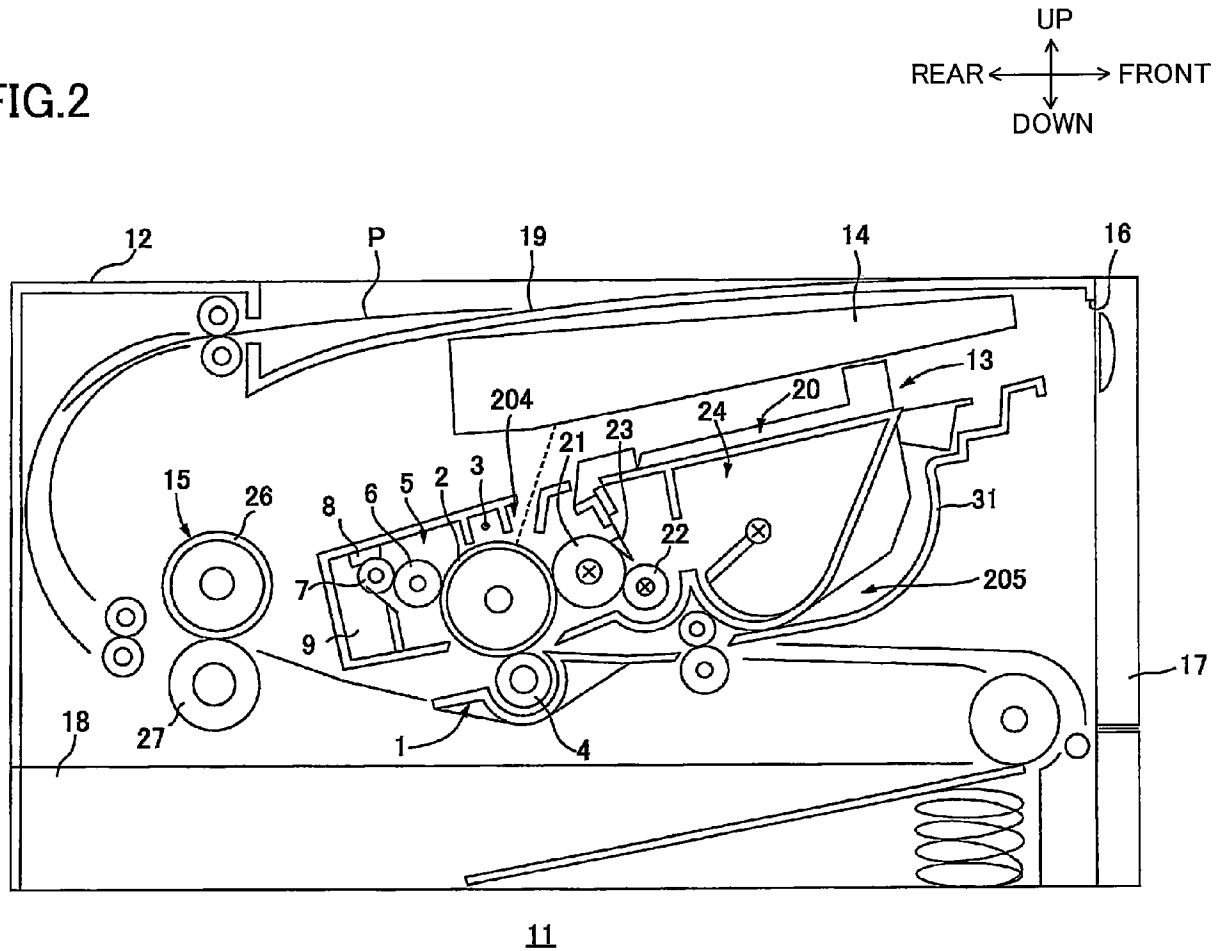
FIG. 2 is a central cross-sectional view of an image forming apparatus that accommodates the drum cartridge according to the embodiment shown in FIG. 1.

As shown in FIG. 2, the drum cartridge 1 is used when mounted in an image forming apparatus 11.

The image forming apparatus 11 is a monochromatic printer having an electrophotographic system. The image forming apparatus 11 includes an apparatus body 12, a process cartridge 13, a scanning unit 14, and a fixing unit 15.

The apparatus body 12 has a box-like shape. The apparatus body 12 includes an access opening 16, a front cover 17, a paper tray 18, and a discharge tray 19.

The access opening 16 is formed in a front end portion of the apparatus body 12. The access opening 16 provides communication between the interior and exterior of the apparatus body 12 and allows the process cartridge 13 to pass therethrough.

The front cover 17 is also provided on the front end portion of the apparatus body 12. The front cover 17 has a general plate shape and extends vertically when in its closed position. The front cover 17 is supported on a front wall of the apparatus body 12 and is capable of pivoting about its bottom edge. The front cover 17 can open and close over the access opening 16.

The paper tray 18 is disposed in a bottom portion of the apparatus body 12. The paper tray 18 is configured to accommodate sheets P of paper.

The discharge tray 19 is provided in the front half of the top wall of the apparatus body 12. The discharge tray 19 is recessed downward relative to a top surface of the apparatus body 12 in order to receive sheets P.

The process cartridge 13 is accommodated in the approximate vertical center of the apparatus body 12. The process cartridge 13 can be mounted in and removed from the apparatus body 12 through the access opening 16. The process cartridge 13 includes the drum cartridge 1 described above, and a developing cartridge 20.

The developing cartridge 20 is mounted in the drum cartridge 1 at a position frontward of the photosensitive drum 2. The developing cartridge 20 includes a developing roller 21, a supply roller 22, a thickness-regulating blade 23, and a toner-accommodating section 24.

The developing roller 21 is rotatably supported in a rear end portion of the developing cartridge 20. The developing roller 21 has a general columnar shape and is oriented with its axis aligned in the left-right direction. The developing roller 21 is in contact with a front surface of the photosensitive drum 2.

The supply roller 22 is disposed on the lower-front side of the developing roller 21. The supply roller 22 has a general columnar shape and is rotatably supported in the developing cartridge 20 with its axis extending along the left-right direction. The supply roller 22 is in contact with a lower-front surface of the developing roller 21.

The thickness-regulating blade 23 is disposed on the upper-front side of the developing roller 21. The thickness-regulating blade 23 contacts a front surface of the developing roller 21.

The toner-accommodating section 24 is formed in the developing cartridge 20 to the front of the supply roller 22 and thickness-regulating blade 23. The toner-accommodating section 24 functions to accommodate toner.

The scanning unit 14 is disposed in the apparatus body 12 above the process cartridge 13. The scanning unit 14 functions to irradiate a laser beam toward the photosensitive drum 2 based on image data.

The fixing unit 15 is disposed in the apparatus body 12 to the rear of the process cartridge 13. The fixing unit 15 includes a heating roller 26, and a pressure roller 27 that contacts a lower-rear surface of the heating roller 26 with pressure.

When the image forming apparatus 11 begins an image-forming operation, the scorotron charger 3 applies a uniform charge to the surface of the photosensitive drum 2. Next, the scanning unit 14 exposes the surface of the photosensitive drum 2, forming an electrostatic latent image on the surface of the photosensitive drum 2 based on image data.

The supply roller 22 supplies toner from the toner-accommodating section 24 onto the developing roller 21. At this time, the toner is positively tribocharged between the developing roller 21 and supply roller 22 so that the developing roller 21 carries the charged toner. The thickness-regulating blade 23 regulates the toner carried on the surface of the developing roller 21 at a uniform thickness.

The toner carried on the developing roller 21 is then supplied to the electrostatic latent image formed on the surface of the photosensitive drum 2. As a result, the photosensitive drum 2 carries a toner image on its surface.

In the meantime, various rollers in the image forming apparatus 11 rotate to feed sheets P from the paper tray 18 and to supply the sheets P one at a time and at a prescribed timing to a position between the photosensitive drum 2 and transfer roller 4. As each sheet P passes between the photosensitive drum 2 and transfer roller 4, the toner image carried on the surface of the photosensitive drum 2 is transferred onto the sheet P.

The sheet P subsequently passes between the heating roller 26 and pressure roller 27 in the fixing unit 15. The heating roller 26 and pressure roller 27 apply heat and pressure to the sheet P, thermally fixing the toner image to the sheet P. Subsequently, various rollers in the image forming apparatus 11 rotate to discharge the sheet P into the discharge tray 19.

The primary roller 6 and secondary roller 7 are positively charged to a higher potential than the surface potential of the photosensitive drum 2. More specifically, the secondary roller 7 is positively charged to a higher potential than the primary roller 6.

The primary roller 6 collects any paper dust deposited on the photosensitive drum 2 when coming into contact therewith. In other words, the primary roller 6 functions to clean the surface of the photosensitive drum 2. The paper dust collected on the primary roller 6 is subsequently attracted to the secondary roller 7 when coming into contact therewith. Next, the sponge scraper 8 scrapes the paper dust off the secondary roller 7, and the paper dust is collected in the collection unit 9.

3. Detailed Structure of the Drum Cartridge

Figure 3:
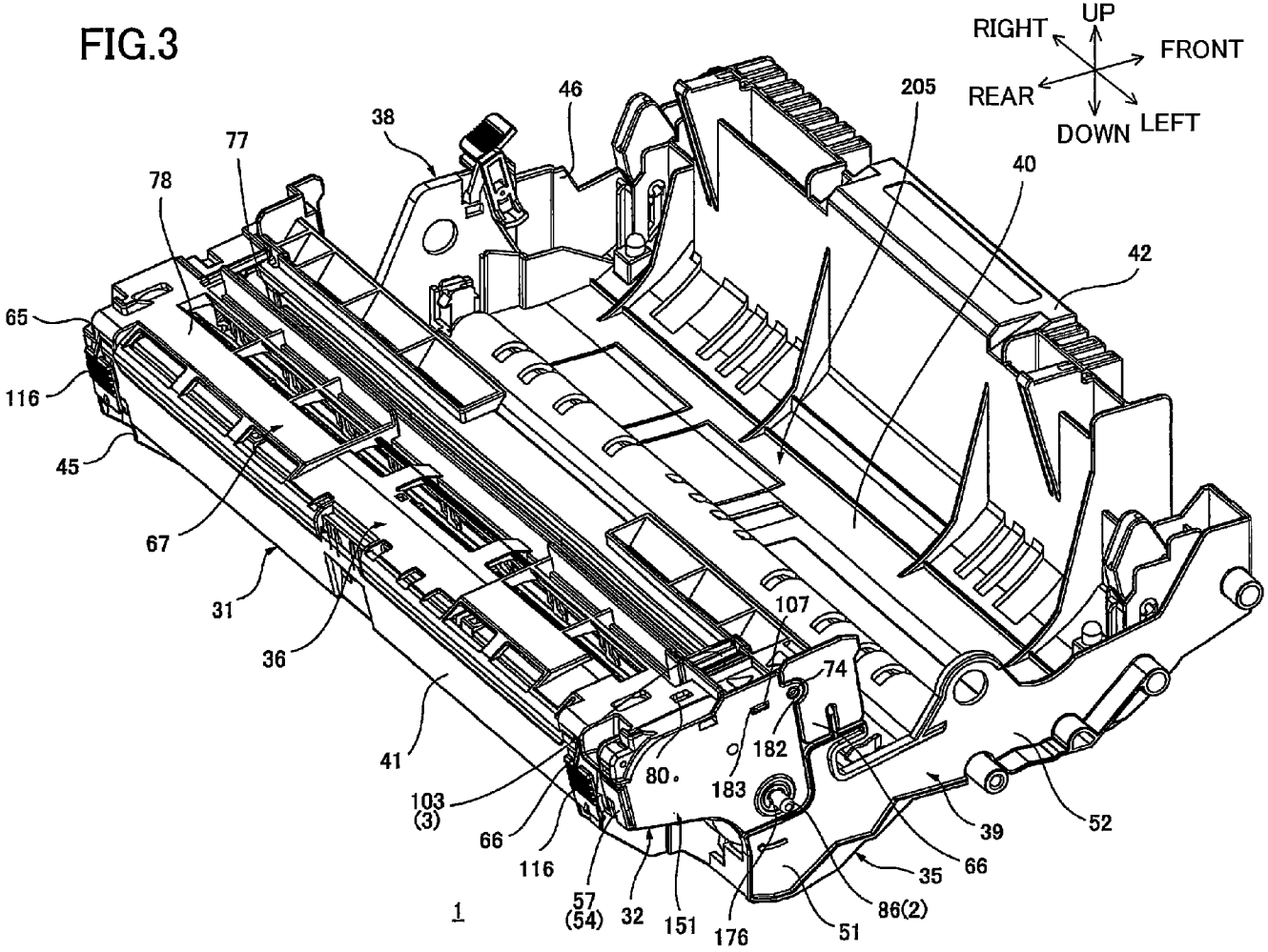
FIG. 3 is a perspective view of the drum cartridge according to the embodiment when viewed from a point leftward and rearward thereof.

As shown in FIGS. 1 and 3, the drum cartridge 1 includes a drum frame 31 as an example of a cartridge frame in the invention, and a drive unit 32, in addition to the photosensitive drum 2, scorotron charger 3, transfer roller 4, and cleaning unit 5 described above.

(1) Drum Frame

As shown in FIG. 3, the drum frame 31 includes a base frame 35 as an example of a first frame in the invention, and a cover frame 36 as an example of a second frame.

The base frame 35 has a frame-like structure that is closed on the bottom and is generally rectangular in a plan view. The base frame 35 is formed of a resin material, such as polystyrene (PS). The base frame 35 integrally includes a right base wall 38 as an example of a first wall, a left base wall 39 as an example of a second wall, a bottom base wall 40, a rear base wall 41, and a front base wall 42.

The right base wall 38 has a plate-like structure that is generally L-shaped in a side view. The right base wall 38 includes a rear right-wall portion 45, and a front-right wall portion 46.

Figure 4B:
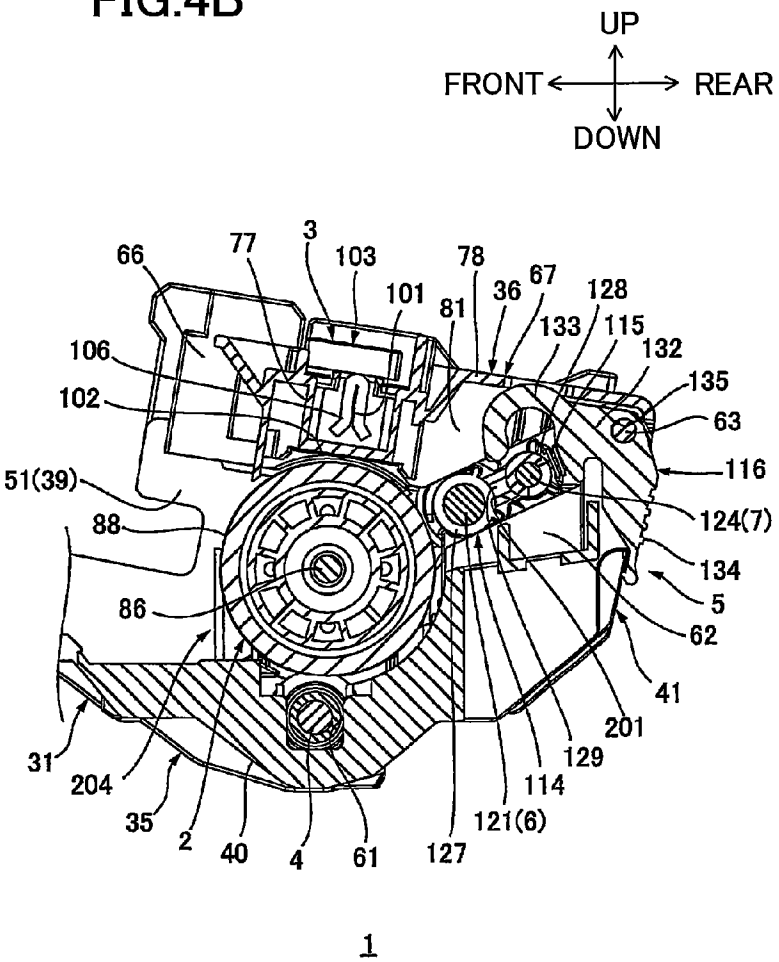
FIG. 4B is a side cross-sectional view of the rear portion of the drum cartridge according to the embodiment shown in FIG. 1, wherein the separation lever is in the first position.
Figure 4A:
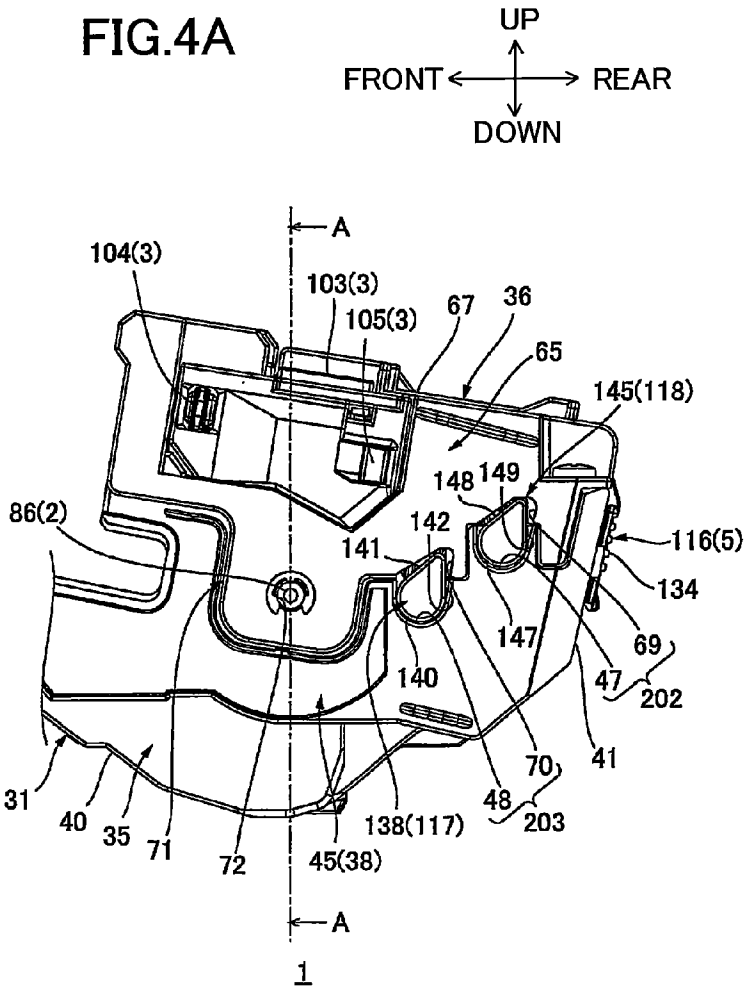
FIG. 4A is a right side view of a rear portion of the drum cartridge according to the embodiment shown in FIG. 1, wherein a separation lever is in a first position.
Figure 7A:
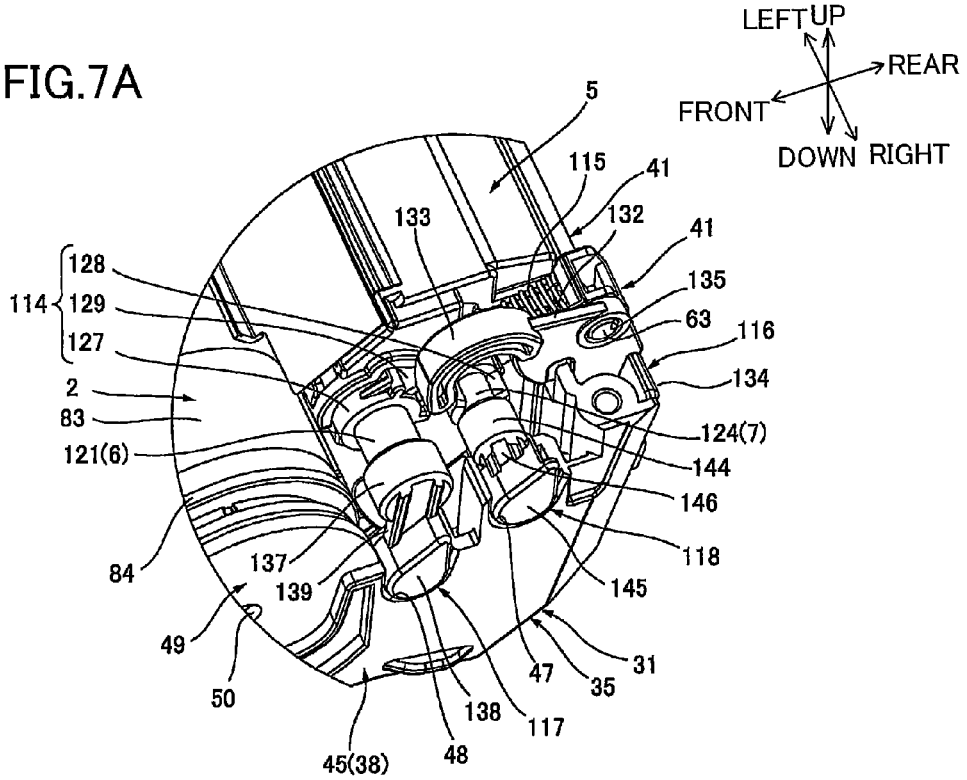
FIG. 7A is a perspective view of the drum cartridge according to the embodiment when viewed from a point rightward and frontward thereof, wherein the cover frame is removed.

As shown in FIG. 4A, the rear right-wall portion 45 constitutes a rear portion of the right base wall 38. The rear right-wall portion 45 has a plate-like structure that is generally rectangular in a side view. The rear right-wall portion 45 has a top edge that slopes in a direction extending from lower front to upper rear. As shown in FIG. 7A, the rear right-wall portion 45 is provided with a first guide groove 47, a second guide groove 48, and a receptacle 49.

As shown in FIGS. 4A and 7A, the first guide groove 47 is recessed downward into a top surface of the rear right-wall portion 45 in its rear portion and has a general U-shape in a side view.

The second guide groove 48 is recessed downward in the top surface of the rear right-wall portion 45 at a position forward from the first guide groove 47 and has a general U-shape in a side view.

The receptacle 49 is a recess formed in a front end portion of the rear right-wall portion 45 and has a general rectangular shape in a side view. The receptacle 49 extends from the top edge of the rear right-wall portion 45 to the approximate vertical center of the same and is recessed leftward from the right surface of the rear right-wall portion 45. The receptacle 49 has an upper portion that protrudes upward from the top edge of the rear right-wall portion 45 so as to have a general semicircular shape in a side view. The receptacle 49 includes a base-side drum-shaft insertion hole 50.

Figure 6:
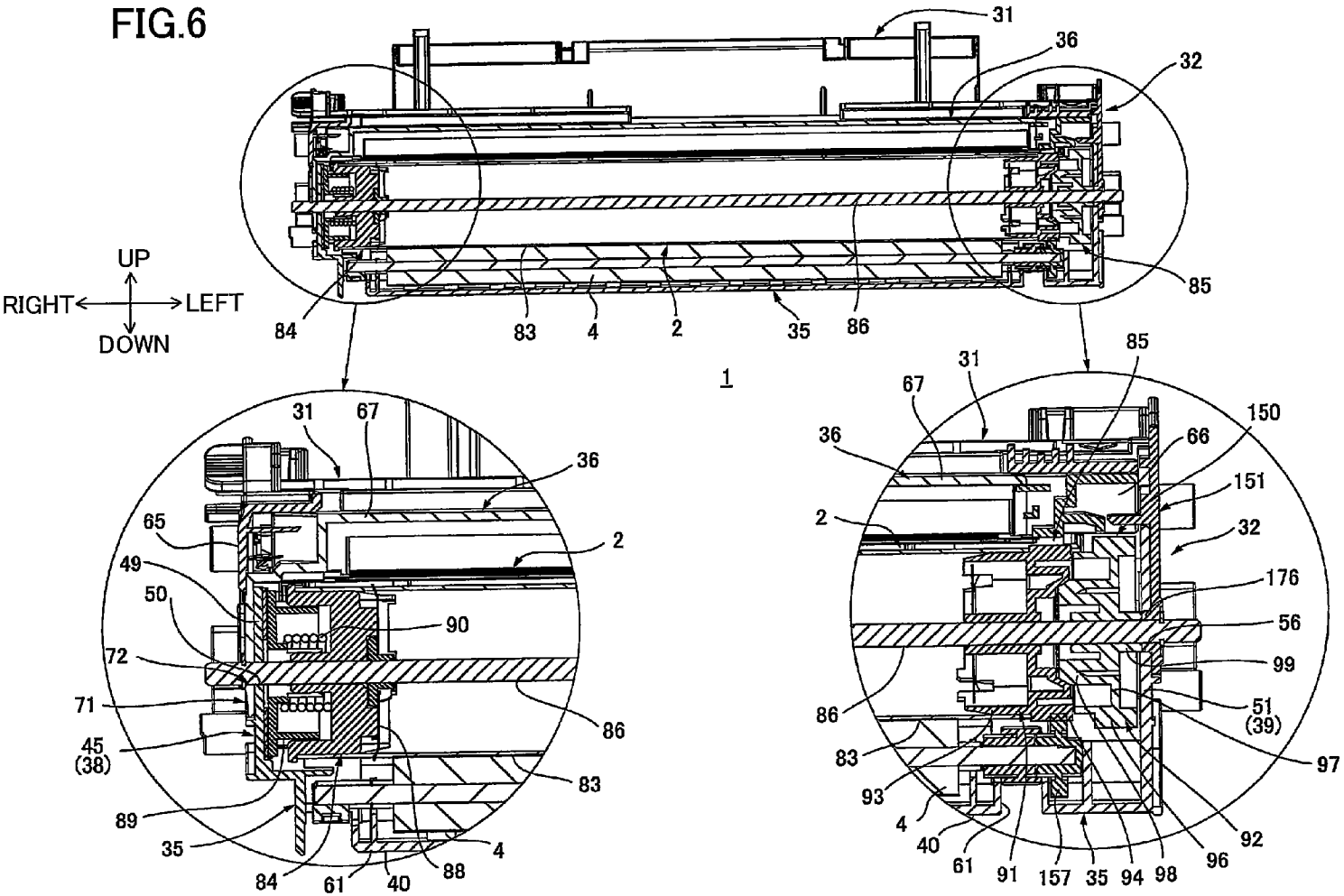
FIG. 6 is a cross-sectional view of the drum cartridge according to the embodiment taken along a plane A-A shown in FIG. 4A.

As shown in FIGS. 6 and 7A, the base-side drum-shaft insertion hole 50 has a general circular shape in a side view and penetrates an approximate vertical and front-rear center region of the receptacle 49. The base-side drum-shaft insertion hole 50 has a diameter that is slightly larger than a diameter of a drum shaft 86 described later.

As shown in FIG. 1, the front-right wall portion 46 constitutes a front portion of the right base wall 38. The front-right wall portion 46 has a plate-like structure that is generally rectangular in a side view and extends forward from a lower front edge of the rear right-wall portion 45.

As shown in FIG. 3, the left base wall 39 is disposed to be separated leftward from the right base wall 38. The left base wall 39 has a plate-like structure that is generally L-shaped in a side view. The left base wall 39 includes a rear left-wall portion 51, and a front left-wall portion 52.

Figure 9:
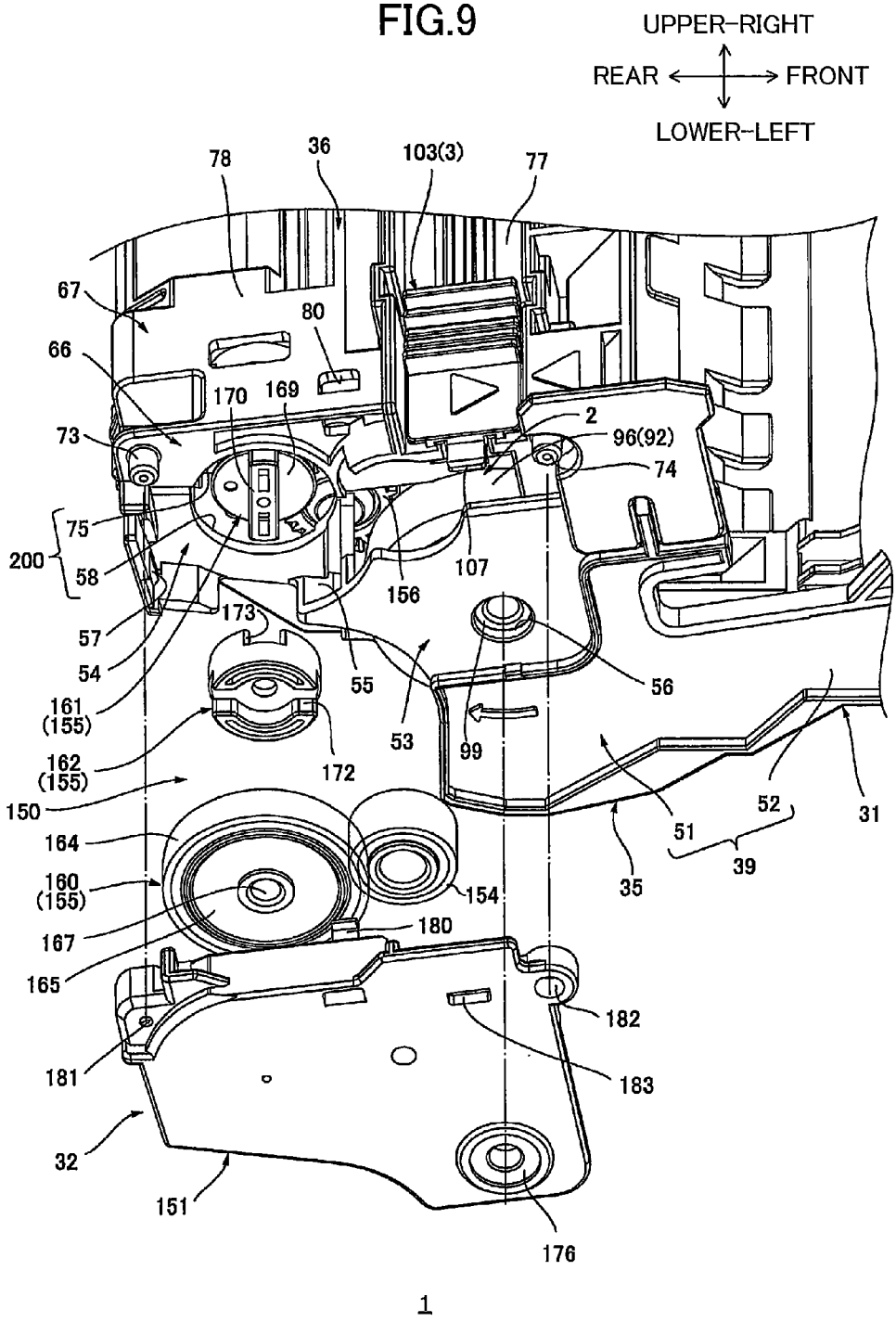
FIG. 9 is an exploded perspective view of a drive unit according to the embodiment shown in FIG. 3 when viewed from a point leftward and upward thereof.
Figure 12:
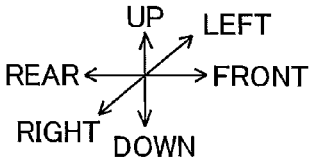
FIG. 12 is a perspective view of the drum cartridge according to the embodiment shown in FIG. 1 when viewed from a point leftward and rearward thereof.
Figure 12:
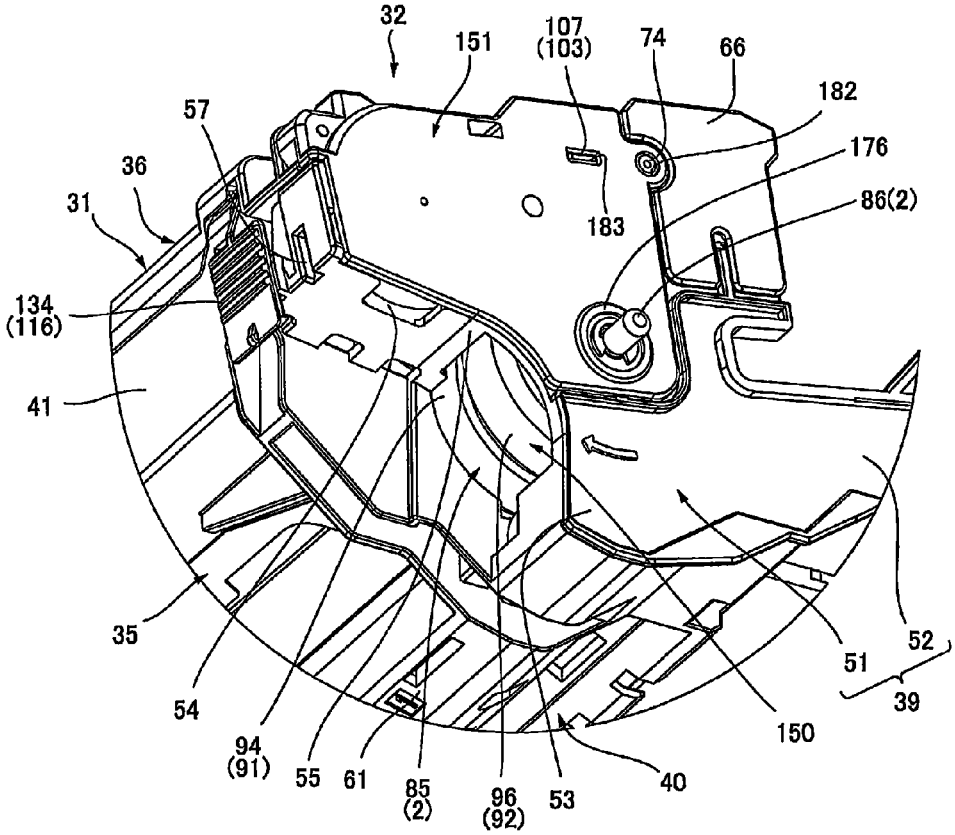

The rear left-wall portion 51 constitutes a rear portion of the right base wall 38. As shown in FIGS. 9 and 12, the rear left-wall portion 51 has a crank-like shape in a plan view. The rear left-wall portion 51 includes a first portion 53, a second portion 54, and a third portion 55.

The first portion 53 constitutes a front portion of the rear left-wall portion 51. As shown in FIG. 9, the first portion 53 has a plate-like structure that is generally rectangular in a side view. The first portion 53 includes a large-diameter through-hole 56.

The large-diameter through-hole 56 has a general circular shape in a side view and penetrates an approximate center region of the first portion 53. The large-diameter through-hole 56 has a diameter larger than the diameter of the base-side drum-shaft insertion hole 50 formed in the right base wall 38. The center of the large-diameter through-hole 56 is aligned with (coincident with) the center of the base-side drum-shaft insertion hole 50 in the left-right direction.

As shown in FIGS. 9 and 12, the second portion 54 constitutes a rear portion of the rear left-wall portion 51. The second portion 54 is disposed rightward of the first portion 53 and has a plate-like structure that is generally rectangular in a side view. The second portion 54 includes a first anchoring part 57, and a base-side semicircular part 58.

The first anchoring part 57 has a plate-like structure that is generally rectangular in a front view and protrudes leftward (outward) from the rear edge of the second portion 54. The first anchoring part 57 also has a through-hole formed in its center region that is capable of engaging with a first anchoring pawl 179 of a gear holder 151 described later.

The base-side semicircular part 58 is recessed downward from a top surface of the second portion 54 in an approximate front-rear center region thereof and has a general semicircular shape in a side view.

The third portion 55 bridges the rear edge of the first portion 53 and the front edge of the second portion 54. The third portion 55 has a plate-like structure that is generally rectangular in a bottom view.

As shown in FIG. 3, the front left-wall portion 52 forms a front portion of the left base wall 39. The front left-wall portion 52 has a plate-like structure that is generally rectangular in a side view and extends forward from a lower-front edge of the rear left-wall portion 51.

The bottom base wall 40 has a front portion that bridges bottom edges of the right base wall 38 and left base wall 39, and a rear portion that bridges approximate vertical center portions of the right base wall 38 and left base wall 39, as illustrated in FIGS. 1 and 12. The bottom base wall 40 has a crank-like shape in a side cross-sectional view and has a plate-like structure that is elongated in the left-right direction. As shown in FIGS. 1 and 4B, the bottom base wall 40 includes a transfer-roller support part 61, and a pair of base-side guide ribs 62.

The transfer-roller support part 61 is provided slightly rearward from a center portion of the bottom base wall 40. The transfer-roller support part 61 is recessed downward in the bottom base wall 40 to form a general U-shape in a side view. The transfer-roller support part 61 can rotatably accommodate the transfer roller 4.

As shown in FIG. 4B, the base-side guide ribs 62 are arranged in a rear end portion of the bottom base wall 40 to be spaced apart from each other in the left-right direction. That is, the base-side guide ribs 62 are respectively provided on the left and right end portions of the bottom base wall 40. The base-side guide ribs 62 have a plate-like structure that is generally rectangular in a side view and protrudes upward from the top surface of the bottom base wall 40. The top edges of the base-side guide ribs 62 are aligned (extend) in the direction extending from lower front to upper rear.

As shown in FIGS. 1 and 3, the rear base wall 41 bridges rear edges of the right base wall 38 and left base wall 39. The rear base wall 41 has a bottom edge that is connected to the rear edge of the bottom base wall 40. The rear base wall 41 has a plate-like structure that is generally rectangular in a rear view. As shown in FIGS. 4B and 7A, the rear base wall 41 includes a pair of separating-lever support bosses 63.

The separating-lever support bosses 63 are respectively disposed on left and right edges on a top portion of the rear base wall 41 at positions above and rearward of the corresponding base-side guide ribs 62 provided on the bottom base wall 40. The separating-lever support bosses 63 have a general columnar shape and protrude outward in the left-right direction from the respective left and right edges of the rear base wall 41.

As shown in FIGS. 1 and 3, the front base wall 42 bridges front edges of the right base wall 38 and left base wall 39. The front base wall 42 has a bottom edge that is connected to the front edge of the bottom base wall 40. The front base wall 42 has a plate-like structure that is generally rectangular in a front view.

The cover frame 36 is disposed above a rear end portion of the base frame 35 so as to cover the photosensitive drum 2. As shown in FIGS. 4A and 9, the cover frame 36 is integrally provided with a right cover wall 65, a left cover wall 66, and a top cover wall 67.

As shown in FIG. 4A, the right cover wall 65 has a plate-like structure that is generally rectangular in a side view. The right cover wall 65 has a bottom surface that slopes in the direction extending from lower front to upper rear. The right cover wall 65 includes a first notched groove 69, a second notched groove 70, and a protruding part 71.

The first notched groove 69 is recessed upward from the bottom surface of the right cover wall 65 at a rear end thereof and has a general U-shape in a side view.

The second notched groove 70 is recessed upward from the bottom surface of the right cover wall 65 at a position forward of the first notched groove 69 and has a general U-shape in a side view.

The protruding part 71 has a plate-like structure that is generally rectangular in a side view and protrudes downward from the bottom surface of the right cover wall 65 at a position forward of the second notched groove 70. The protruding part 71 includes a cover-side drum-shaft insertion hole 72.

The cover-side drum-shaft insertion hole 72 has a general circular shape in a side view and penetrates an approximate vertical and front-rear center portion of the protruding part 71. The cover-side drum-shaft insertion hole 72 has a diameter that is slightly larger than the diameter of the drum shaft 86 described later.

As shown in FIG. 9, the left cover wall 66 has a plate-like structure that is generally rectangular in a side view. The left cover wall 66 includes a first positioning boss 73, a second positioning boss 74, and a cover-side semicircular part 75.

The first positioning boss 73 has a general columnar shape and protrudes leftward from a left surface of the left cover wall 66 at a rear end thereof.

The second positioning boss 74 has a general cylindrical shape and protrudes leftward from the left surface of the left cover wall 66 at a front end thereof.

The cover-side semicircular part 75 is recessed upward into the bottom surface of the left cover wall 66 at a position forward of the first positioning boss 73. The cover-side semicircular part 75 has a general semicircular shape in a side view.

As shown in FIGS. 1 and 3, the top cover wall 67 bridges top edges of the right cover wall 65 and left cover wall 66. As shown in FIG. 1, the top cover wall 67 includes a charger support part 77, and a rear top-wall portion 78.

The charger support part 77 constitutes a front portion of the top cover wall 67. The charger support part 77 is elongated in the left-right direction and has a general U-shape in a cross-sectional view, with the opening of the "U" facing downward, as shown in FIG. 4B. The charger support part 77 houses the scorotron charger 3 described above.

The rear top-wall portion 78 constitutes a rear portion of the top cover wall 67. The rear top-wall portion 78 has a plate-like structure that is generally rectangular in a plan view and elongated in the left-right direction. As shown in FIGS. 4B and 9, the rear top-wall portion 78 includes a second anchoring part 80, and a pair of cover-side guide ribs 81.

The second anchoring part 80 is disposed in a left-front corner of the rear top-wall portion 78. The second anchoring part 80 penetrates the rear top-wall portion 78 vertically for permitting engagement with a second anchoring pawl 180 of the gear holder 151 described later.

As shown in FIG. 4B, the cover-side guide ribs 81 are disposed to be separated from each other in the left-right direction. Specifically, the cover-side guide ribs 81 are respectively disposed on left and right ends of the rear top-wall portion 78. The cover-side guide ribs 81 have a plate-like structure that is generally triangular in a side view and protrudes downward from a bottom surface of the rear top-wall portion 78. The cover-side guide ribs 81 have bottom edges that slope in the direction extending from lower front to upper rear.

As shown in FIG. 3, assembling the cover frame 36 on the base frame 35 configures the drum frame 31.

More specifically, the cover frame 36 is assembled on the base frame 35 such that the right cover wall 65 of the cover frame 36 vertically overlaps the rear right-wall portion 45 of the right base wall 38, the left cover wall 66 vertically overlaps the rear left-wall portion 51 of the left base wall 39, and the rear portion of the rear top-wall portion 78 vertically overlaps the rear base wall 41.

By assembling the cover frame 36 to the base frame 35 in this way, on the right side of the drum frame 31, the bottom edge of the right cover wall 65 contacts the top edge of the rear right-wall portion 45 constituting the right base wall 38, and the protruding part 71 of the right cover wall 65 overlaps the right base wall 38 in the left-right direction, as illustrated in FIGS. 4A and 6. At this time, the base-side drum-shaft insertion hole 50 is also aligned with the cover-side drum-shaft insertion hole 72 in the left-right direction.

Further, the first guide groove 47 formed in the right base wall 38 vertically opposes the first notched groove 69 in the right cover wall 65, as shown in FIG. 4. Together, the first guide groove 47 and first notched groove 69 construct a secondary-electrode receiving groove 202 that can receive a contact part 145 of a secondary electrode 118 described later. In other words, the secondary-electrode receiving groove 202 extends vertically between the base frame 35 and cover frame 36.

Similarly, the second guide groove 48 in the right base wall 38 vertically opposes the second notched groove 70 in the right cover wall 65. The second guide groove 48 and second notched groove 70 together construct a primary-electrode receiving groove 203 that can receive a contact part 138 of a primary electrode 117 described later. In other words, the primary-electrode receiving groove 203 extends vertically between the base frame 35 and cover frame 36.

As shown in FIGS. 6 and 9, the bottom edge of the left cover wall 66 contacts the top edge of the left base wall 39 on the left side of the drum frame 31.

At this time, the base-side semicircular part 58 in the left base wall 39 vertically opposes the cover-side semicircular part 75 in the left cover wall 66, as shown in FIG. 9. Together, the base-side semicircular part 58 and cover-side semicircular part 75 construct an Oldham-coupling connection hole 200 in which an Oldham coupling 155 described later is disposed.

As shown in FIG. 4B, the top surfaces on the base-side guide ribs 62 of the bottom base wall 40 oppose, with a fixed gap, the corresponding bottom surfaces on the cover-side guide ribs 81 of the top cover wall 67 in a direction extending from upper front to lower front. Together, the base-side guide ribs 62 and the cover-side guide ribs 81 construct a pair of roller-shaft guides 201.

In the drum frame 31, as shown in FIGS. 1 and 3, a first accommodating section 204 is defined by the rear right-wall portion 45 of the right base wall 38, the rear left-wall portion 51 of the left base wall 39, the rear portion of the bottom base wall 40, the rear base wall 41, and the cover frame 36 having the above construction. The first accommodating section 204 serves to accommodate the photosensitive drum 2 and cleaning unit 5.

Further, a second accommodating section 205 is defined by the portion of the drum frame 31 forward of the first accommodating section 204, and specifically the front-right wall portion 46 constituting the right base wall 38 of the base frame 35, the front left-wall portion 52 constituting the left base wall 39, the front portion of the bottom base wall 40, and the front base wall 42. The second accommodating section 205 serves to accommodate the developing cartridge 20.

(2) Photosensitive Drum

As shown in FIG. 6, the photosensitive drum 2 includes a drum body 83 as an example of a drum body, a pressing member 84, a bearing member 85, and the drum shaft 86 as an example of a first rotational shaft.

The drum body 83 has a general cylindrical shape with its axis oriented in the left-right direction. The drum body 83 is disposed between the right base wall 38 and left base wall 39. More specifically, the drum body 83 includes a metal tube having a general cylindrical shape that is arranged with its axis oriented in the left-right direction, and a photosensitive layer formed of a resin material that coats the surface of the metal tube.

The pressing member 84 is disposed on a right end portion of the drum body 83. The pressing member 84 includes a right drum flange 88, a friction member 89, and a compression spring 90.

The right drum flange 88 has a general cylindrical shape that is closed on its right end. The right drum flange 88 has an outer diameter approximately equal to an inner diameter of the drum body 83. A through-hole is formed in a center part of the closed right end portion of the right drum flange 88 for inserting the drum shaft 86. The right drum flange 88 is fixed in the right end portion of the drum body 83 so as to be incapable of rotating relative thereto.

The friction member 89 has a general cylindrical shape and is closed on its right end. The friction member 89 has an outer diameter slightly smaller than an inner diameter of the right drum flange 88. A through-hole is also formed in a center portion of the closed right end of the friction member 89 for inserting the drum shaft 86. The friction member 89 is fitted into the right end portion of the right drum flange 88 such that the friction member 89 can slide in the left-right direction relative to the right end portion of the right drum flange 88.

The compression spring 90 is a coil spring arranged with its axis aligned in the left-right direction. The compression spring 90 is disposed in a compressed state between the closed right end portion of the right drum flange 88 and the closed right end portion of the friction member 89. With this arrangement, the compression spring 90 can apply a pressing force to the friction member 89 rightward and can bias the drum body 83 leftward through the right drum flange 88.

The bearing member 85 is disposed on a left end portion of the drum body 83. The bearing member 85 includes a first left drum flange 91, and a second left drum flange 92.

The first left drum flange 91 is integrally provided with an insertion part 93, and a flange gear 94.

The insertion part 93 has a general cylindrical shape that is closed on its left end. The outer diameter of the insertion part 93 is approximately equal to the inner diameter of the drum body 83. A through-hole is formed in the center of the closed left end of the insertion part 93 for inserting the drum shaft 86.

The flange gear 94 has a general cylindrical shape and extends continuously leftward from the left end of the insertion part 93. The outer diameter of the flange gear 94 is larger than the outer diameter of the insertion part 93.

The second left drum flange 92 is formed of a resin material such as polyacetal (POM). The second left drum flange 92 is integrally provided with a drum gear 96 as an example of a drum gear, a disc part 97, a fitting part 98, and an inner cylinder part 99.

The drum gear 96 has a general cylindrical shape that is elongated in the left-right direction. The drum gear 96 has an outer diameter greater than the outer diameter of the flange gear 94.

The disc part 97 has a general disc shape and expands radially inward from an inner surface of the drum gear 96 at the approximate left-right center thereof.

The fitting part 98 has a general cylindrical shape and protrudes rightward from a right surface of the disc part 97. The outer diameter of the fitting part 98 is approximately equal to the inner diameter of the flange gear 94, while the inner diameter of the fitting part 98 is larger than the diameter of the drum shaft 86 and the outer diameter of the inner cylinder part 99.

The inner cylinder part 99 has a general cylindrical shape and penetrates the center of the disc part 97 in the left-right direction. The outer diameter of the inner cylinder part 99 is slightly smaller than the diameter of the large-diameter through-hole 56 formed in the left base wall 39. The inner diameter of the inner cylinder part 99 is approximately equal to the outer diameter of the drum shaft 86. The inner cylinder part 99 has a left end that extends farther leftward than the left end of the drum gear 96.

The drum shaft 86 has a general columnar shape that is elongated in the left-right direction and defines a radial center of the photosensitive drum 2. The drum shaft 86 is inserted through the through-hole formed in the pressing member 84 and the inner cylinder part 99 of the bearing member 85.

The photosensitive drum 2 is rotatably accommodated in a front portion of the first accommodating section 204 provided in the drum frame 31 (see FIG. 1) by inserting the right end of the drum shaft 86 through the cover-side drum-shaft insertion hole 72 of the right cover wall 65 and the base-side drum-shaft insertion hole 50 of the right base wall 38 and by inserting the left end of the drum shaft 86 through the large-diameter through-hole 56 formed in the left base wall 39.

At this time, the inner cylinder part 99 of the second left drum flange 92 constituting the bearing member 85 is positioned within the large-diameter through-hole 56 of the rear left-wall portion 51 constituting the left base wall 39 in a left-right projection (see FIG. 9).

(3) Scorotron Charger

As shown in FIGS. 1 and 4B, the scorotron charger 3 is supported by the charger support part 77 of the cover frame 36 at a position above and separated from the photosensitive drum 2, as described above. The scorotron charger 3 includes a charging wire 101 as an example of a wire of the invention, a grid 102, a wire cleaner 103, and, as shown in FIG. 4A, a charging electrode 104 and a grid electrode 105.

As shown in FIG. 1, the charging wire 101 is stretched taut in the left-right direction between the right cover wall 65 and left cover wall 66 and supported by the same. The charging wire 101 is positioned above the photosensitive drum 2 and spaced apart therefrom.

The grid 102 has a general U-shape in a side view with the opening of the "U" facing upward. The grid 102 is arranged to surround the charging wire 101 from below.

As shown in FIGS. 4B and 9, the wire cleaner 103 as an example of a wire cleaner of the invention is supported on an upper portion of the charger support part 77 so as to be capable of sliding in the left-right direction for cleaning the charging wire 101. The wire cleaner 103 has a plate-like structure that is generally rectangular in a plan view. The wire cleaner 103 includes a cleaning part 106, and an anchoring protrusion 107 as an example of an anchoring part.

As shown in FIG. 4B, the cleaning part 106 is disposed inside the grid 102. The cleaning part 106 is configured of a cleaning member formed of a sponge or nonwoven fabric for gripping the charging wire 101 and is capable of sliding along the charging wire 101.

As shown in FIG. 9, the anchoring protrusion 107 protrudes leftward from the left side of the cleaning part 106 in the approximate front-rear center thereof.

As shown in FIG. 4A, the charging electrode 104 is electrically connected to the charging wire 101. The charging electrode 104 is exposed in a front end portion of the left cover wall 66 constituting the cover frame 36.

The grid electrode 105 is electrically connected to the grid 102. The grid electrode 105 is exposed from an approximate front-rear center region of the left cover wall 66.

(4) Cleaning Unit

As shown in FIGS. 1 and 4B, in addition to the primary roller 6, secondary roller 7, sponge scraper 8, and collection unit 9 described above, the cleaning unit 5 also includes a pair of bearings 114, a pair of urging members 115, a pair of separating levers 116, a primary electrode 117, and a secondary electrode 118.

The primary roller 6 is disposed in a front end portion of the cleaning unit 5. The primary roller 6 includes a primary-roller shaft 121 as an example of a second rotational shaft, and a primary-roller body 122.

The primary-roller shaft 121 has a general columnar shape that is elongated in the left-right direction. The primary-roller shaft 121 has a diameter smaller than the width of the roller-shaft guides 201 (also see FIG. 5B). Left and right ends of the primary-roller shaft 121 are inserted through the corresponding roller-shaft guides 201 from the inner left-right sides of the same.

The primary-roller body 122 has a general cylindrical shape and covers an approximate left-right center region of the primary-roller shaft 121. The lower-front surface of the primary-roller body 122 is in contact with the upper-rear surface of the photosensitive drum 2.

The secondary roller 7 is disposed upward and rearward of the primary roller 6. The secondary roller 7 is integrally configured of a secondary-roller shaft 124, and a secondary-roller body 125.

The secondary-roller shaft 124 has a general columnar shape that is elongated in the left-right direction. The diameter of the secondary-roller shaft 124 is smaller than the diameter of the primary-roller shaft 121 and the width of the roller-shaft guides 201. Left and right ends of the secondary-roller shaft 124 are inserted into the corresponding roller-shaft guides 201 from the inner left-right sides of the same.

The secondary-roller body 125 expands radially outward from the secondary-roller shaft 124 in an approximate left-right center region of the same. The diameter of the secondary-roller body 125 is larger than the diameter of the secondary-roller shaft 124.

Figure 7B:
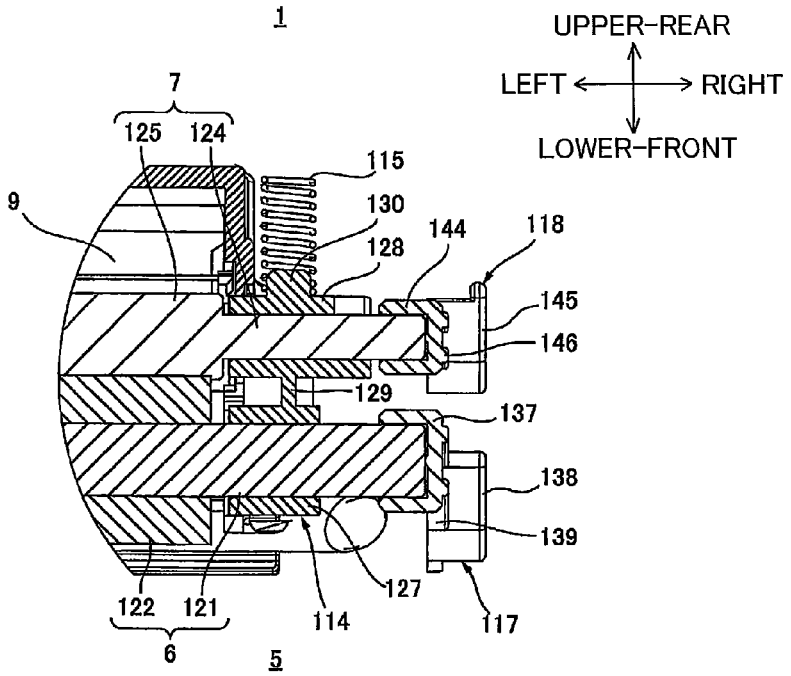
FIG. 7B is a cross-sectional view of the drum cartridge according to the embodiment taken along a plane passing both centers of a primary roller and a secondary roller according to the embodiment shown in FIG. 7A, wherein the base frame is omitted for explanatory purpose.

The bearings 114 are disposed inside the corresponding roller-shaft guides 201. As shown in FIGS. 7A and 7B, each bearing 114 includes a primary-roller-shaft insertion part 127, a secondary-roller-shaft insertion part 128, and a coupling part 129.

The primary-roller-shaft insertion part 127 has a general cylindrical shape that is elongated in the left-right direction. The primary-roller-shaft insertion part 127 has an inner diameter approximately equal to the outer diameter of the primary-roller shaft 121.

The secondary-roller-shaft insertion part 128 is arranged upward and rearward of the primary-roller-shaft insertion part 127. The secondary-roller-shaft insertion part 128 has a general cylindrical shape that is elongated in the left-right direction. The secondary-roller-shaft insertion part 128 includes a protruding part 130 (shown in FIG. 7B).

The protruding part 130 has a general columnar shape and protrudes diagonally upward and rearward from the upper-rear surface of the secondary-roller-shaft insertion part 128.

The coupling part 129 couples the upper-rear surface of the primary-roller-shaft insertion part 127 to the lower-front surface of the secondary-roller-shaft insertion part 128. The coupling part 129 has a general square columnar shape and is elongated in the direction extending from lower front to upper rear (see FIG. 4B).

The bearings 114 can rotatably support the primary roller 6 when the both ends of the primary-roller shaft 121 of the primary roller 6 are inserted into the corresponding primary-roller-shaft insertion parts 127. Similarly, the bearings 114 can rotatably support the secondary roller 7 when the both ends of the secondary-roller shaft 124 of the secondary roller 7 are inserted into the corresponding secondary-roller-shaft insertion parts 128.

In this way, the bearings 114 rotatably support both the primary roller 6 and secondary roller 7 in the corresponding roller-shaft guides 201. The bearings 114 are configured to move together with the primary roller 6 and secondary roller 7 in the direction extending from lower front to upper rear, as will be described later.

The urging members 115 are coil springs whose axes are oriented in the direction extending from lower front to upper rear. The lower-front end of each urging member 115 is fitted around the protruding part 130 of the corresponding bearing 114, while the upper-rear end of each urging member 115 contacts the inner surface on the top portion of the rear base wall 41 constituting the base frame 35. With this configuration, the urging members 115 urge the corresponding bearings 114 diagonally downward and forward. That is, the urging members 115 are configured to urge the primary roller 6 toward the photosensitive drum 2 so as to place the primary roller 6 in contact with the photosensitive drum 2.

As shown in FIG. 3, the separating levers 116 are respectively disposed on the left and right end portions of the drum frame 31. As shown in FIGS. 4B and 7A, each separating lever 116 includes a base part 132, a hook 133, and a grip part 134.

The base part 132 has a plate-like structure that, in a side view, is formed in a general obtuse-angled triangular shape, where the obtuse angle portion of the triangular shape is positioned on the upper-rear side. The base part 132 includes an engaging hole 135.

In a side view, the engaging hole 135 is positioned in the obtuse-angled portion of the base part 132 to penetrate therethrough in the left-right direction. The engaging hole 135 has a general circular shape in a side view. The engaging hole 135 has a diameter approximately equal to the diameter of the separating-lever support bosses 63 provided on the rear base wall 41.

In a side view, the hook 133 is formed continuously with a front end of the base part 132. The hook 133 has a hook-like shape that is generally semi-annular in a side view. The hook 133 curves downward while protruding from the front end of the base part 132 when viewed from the side. The hook 133 has an inner surface whose radius of curvature is slightly larger than the diameter of the secondary-roller shaft 124.

In a side view, the grip part 134 is formed continuously with a rear end of the base part 132. In other words, the grip part 134 is provided on a side opposite to the engaging hole 135 with respect to the hook 133. The grip part 134 has a plate-like structure that is generally rectangular in a rear view and extends orthogonally to the base part 132 in a plan view.

By fitting the engaging holes 135 of the separating levers 116 over the corresponding separating-lever support bosses 63 of the rear base wall 41, the separating levers 116 can pivot about the separating-lever support bosses 63.

Figure 5B:
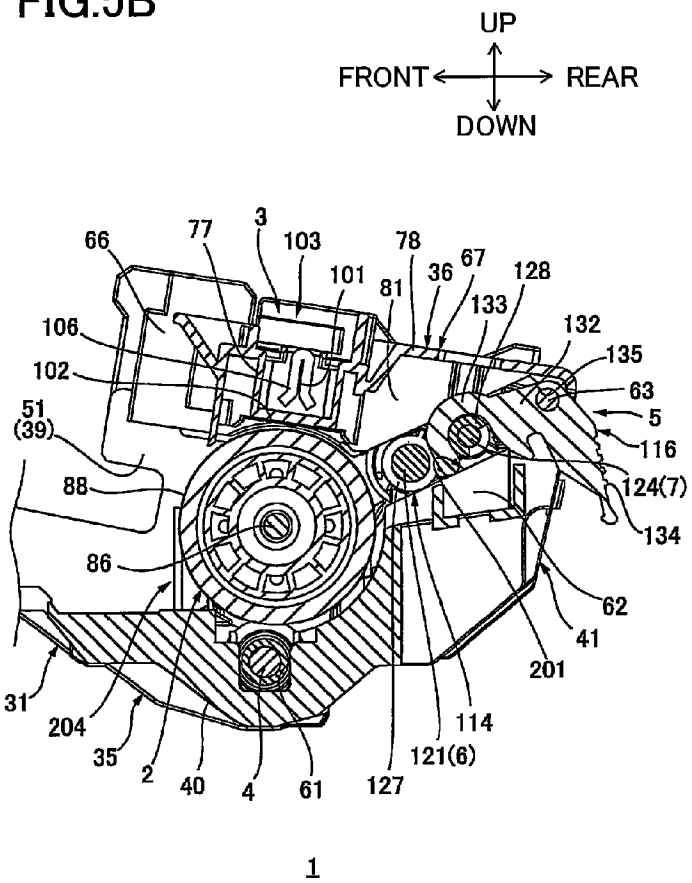
FIG. 5B is a side cross-sectional view of the rear portion of the drum cartridge according to the embodiment shown in FIG. 1, wherein the separation lever is in the second position.
Figure 5A:
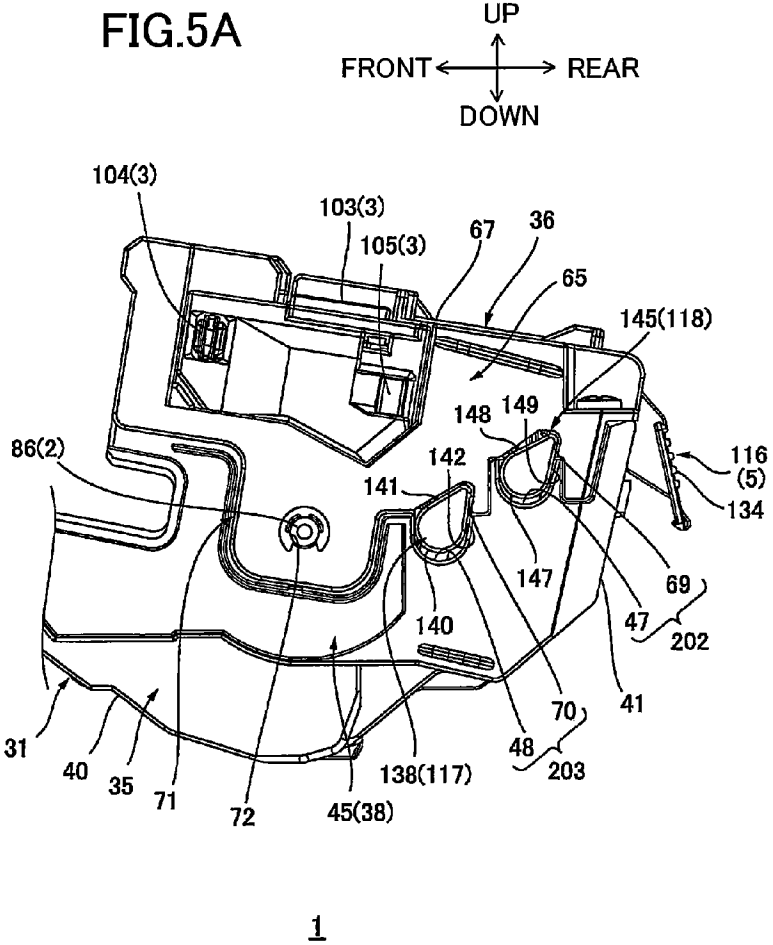
FIG. 5A is a right side view of the rear portion of the drum cartridge according to the embodiment shown in FIG. 1, wherein the separation lever is in a second position.

More specifically, each separating lever 116 can pivot between a first position shown in FIG. 4B, and a second position shown in FIG. 5B. In the first position, the grip part 134 extends along the rear surface of the rear base wall 41, and the hook 133 is positioned above and separated from the secondary-roller-shaft insertion part 128 of the corresponding bearing 114. In the second position, the grip part 134 is separated from the rear base wall 41, and the hook 133 is hooked around the secondary-roller-shaft insertion part 128 of the corresponding bearing 114.

When the separating levers 116 are placed in the first position shown in FIG. 4B, the urging members 115 urging the bearings 114 diagonally downward and forward place the primary roller 6 in contact with the upper rear surface of the photosensitive drum 2. When the separating levers 116 are placed in the second position shown in FIG. 5B, the bearings 114 are lifted in a direction diagonally upward and rearward by the hooks 133 against the urging force of the urging members 115, so that the primary roller 6 is separated from the photosensitive drum 2. The separating levers 116 are normally in the first position shown in FIG. 4B.

As shown in FIG. 7A, the primary electrode 117 is provided on the right end of the primary-roller shaft 121. The primary electrode 117 is formed of an electrically conductive resin and is configured to supply a primary cleaning bias to the primary roller 6 when electrically connected to a third device-side electrode 193 (described later) of the apparatus body 12.

Figure 8A:
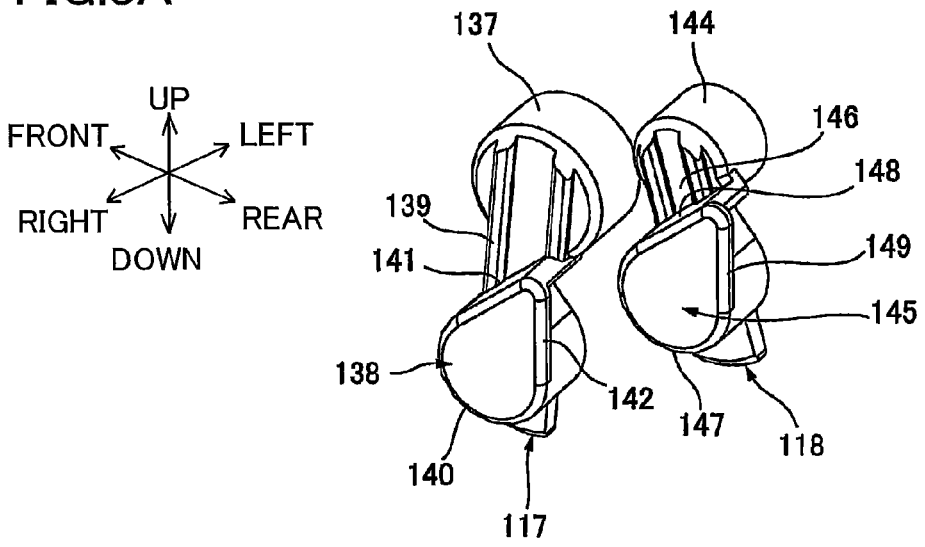
FIG. 8A is a perspective view of the primary electrode and the secondary electrode shown in FIG. 7A when viewed from a point rightward and rearward thereof.
Figure 8B:
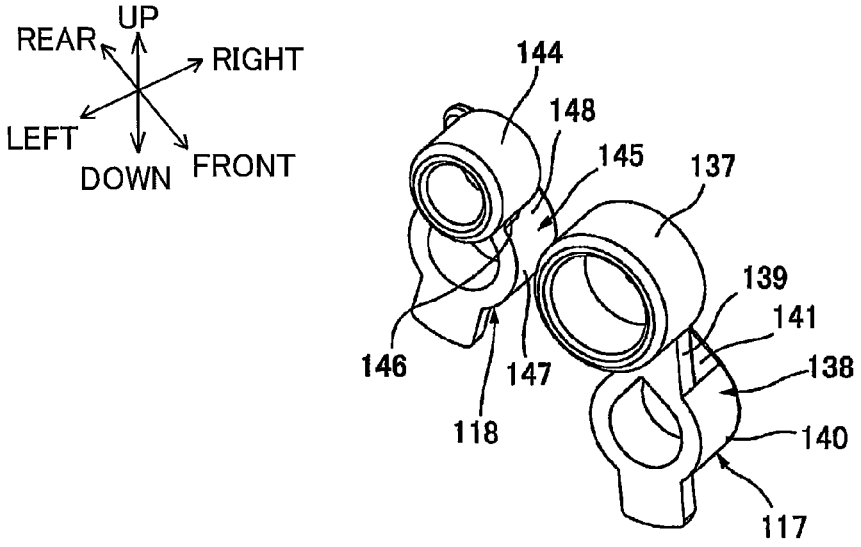
FIG. 8B is a perspective view of the primary electrode and the secondary electrode shown in FIG. 7A when viewed from a point leftward and frontward thereof.

As shown in FIGS. 8A and 8B, the primary electrode 117 includes a roller-shaft support part 137, a contact part 138, and a coupling plate 139.

The roller-shaft support part 137 has a general cylindrical shape and is closed on its right end. The roller-shaft support part 137 has an inner diameter approximately equal to the diameter of the primary-roller shaft 121.

The contact part 138 is generally cylindrical with a teardrop-like shape in a side view that is closed on the right side. The contact part 138 has an outer peripheral surface whose bottom portion is defined as a curved part 140. The curved part 140 has a general semicircular shape in a side view. A part of the outer peripheral surface on the contact part 138 that extends diagonally upward and rearward from a front edge of the curved part 140 is defined as a first linear part 141, while another part of the outer peripheral surface on the contact part 138 that extends diagonally upward and forward from a rear edge of the curved part 140 is defined as a second linear part 142. The first and second linear parts 141 and 142 define a distance therebetween that tapers toward the top until the first and second linear parts 141 and 142 are connected to each other. That is, the first linear part 141 has a top edge that is formed continuously with a top edge of the second linear part 142.

The coupling plate 139 couples a lower-right end of the roller-shaft support part 137 to an upper-left end of the contact part 138. The coupling plate 139 has a plate-like structure that is generally rectangular in a side view.

As shown in FIGS. 7A and 7B, the roller-shaft support part 137 of the primary electrode 117 rotatably receives the right end of the primary-roller shaft 121. As shown in FIG. 4A, the contact part 138 of the primary electrode 117 is disposed within the primary-electrode receiving groove 203.

The contact part 138 of the primary electrode 117 is positioned relatively low in the primary-electrode receiving groove 203 when the separating lever 116 is in the first position, i.e., when the primary roller 6 is in contact with the upper-rear surface of the photosensitive drum 2.

At this time, the curved part 140 of the primary electrode 117 contacts the inner surface along the bottom surface of the primary-electrode receiving groove 203. On the other hand, the first and second linear parts 141 and 142 of the primary electrode 117 do not contact the inner surface of the primary-electrode receiving groove 203 and a gap is formed between these parts.

When the separating lever 116 is moved from the first position to the second position, i.e., when the primary roller 6 is separated from the photosensitive drum 2, the contact part 138 of the primary electrode 117 rotates slightly clockwise in a right side view while moving upward within the primary-electrode receiving groove 203.

At this time, the curved part 140 of the primary electrode 117 is in contact with the inner surface along the front edge of the primary-electrode receiving groove 203. Further, the first linear part 141 and second linear part 142 of the primary electrode 117 do not contact the inner surface of the primary-electrode receiving groove 203 and a gap is formed between these parts.

By moving the separating lever 116 between the first and second positions in this way, the primary electrode 117 moves vertically within the primary-electrode receiving groove 203 while rotating slightly in a side view. In other words, the primary electrode 117 rotates slightly while moving in a direction intersecting the direction extending from the lower front to upper rear in which the primary roller 6 moves.

As shown in FIG. 7A, the secondary electrode 118 is provided on the right end of the secondary-roller shaft 124 and is positioned upward and rearward of the primary electrode 117. The secondary electrode 118 is formed of an electrically conductive resin and is configured to supply a secondary cleaning bias to the secondary roller 7 when electrically connected to a fourth device-side electrode 194 (described later) of the apparatus body 12.

As shown in FIGS. 8A and 8B, the secondary electrode 118 includes a roller-shaft support part 144, a contact part 145, and a coupling plate 146.

The roller-shaft support part 144 has a general cylindrical shape that is closed on its right side. The roller-shaft support part 144 has an inner diameter that is approximately equal to the diameter of the secondary-roller shaft 124.

The contact part 145 is generally cylindrical with a teardrop-like shape in a side view that is closed on the right side. The contact part 145 has an outer circumferential surface whose bottom portion is defined as a curved part 147. The curved part 147 has a general semicircular shape in a side view. A segment of the outer circumferential surface of the contact part 138 that extends upward and rearward from a front edge of the curved part 147 is defined as a first linear part 148, while another segment of the outer circumferential surface that extends upward and forward from a rear edge of the curved part 147 is defined as a second linear part 149. The first and second linear parts 148 and 149 define a distance therebetween that gradually narrows toward the top where the two components are coupled. In other words, the first linear part 148 has a top edge that is formed continuously with a top edge of the second linear part 149.

The coupling plate 146 couples a lower-right end of the roller-shaft support part 144 with an upper-left end of the contact part 145. The coupling plate 146 has a plate-like structure that is generally rectangular in a side view. The vertical dimension of the coupling plate 146 is shorter than the vertical dimension of the coupling plate 139 constituting the primary electrode 117.

As shown in FIGS. 7A and 7B, the roller-shaft support part 144 of the secondary electrode 118 rotatably receives the right end of the secondary-roller shaft 124. As shown in FIG. 4A, the contact part 145 of the secondary electrode 118 is disposed within the secondary-electrode receiving groove 202.

When the separating lever 116 is in the first position, i.e., when the primary roller 6 is in contact with the upper-rear surface of the photosensitive drum 2, the contact part 145 of the secondary electrode 118 is positioned relatively low in the secondary-electrode receiving groove 202. At this time, the curved part 147 of the secondary electrode 118 is in contact with the inner surface along the bottom surface of the secondary-electrode receiving groove 202. The first linear part 148 and second linear part 149 of the secondary electrode 118 are not in contact with the inner surface of the secondary-electrode receiving groove 202 and a gap is formed between these parts.

When the separating lever 116 is moved from the first position to the second position, i.e., when the primary roller 6 separates from the photosensitive drum 2 and the secondary roller 7 moves diagonally upward and rearward together with the primary roller 6, the contact part 145 of the secondary electrode 118 moves upward within the secondary-electrode receiving groove 202 while rotating slightly clockwise in a right side view.

At this time, the curved part 147 of the secondary electrode 118 is in contact with the inner surface along the front edge of the secondary-electrode receiving groove 202. The first linear part 148 and second linear part 149 of the secondary electrode 118 do not contact the inner surface of the secondary-electrode receiving groove 202 but are separated therefrom.

By moving the separating lever 116 between the first and second positions in this way, the secondary electrode 118 moves vertically within the secondary-electrode receiving groove 202 while rotating slightly in a side view. That is, the secondary electrode 118 rotates slightly while moving in the direction that intersects the direction extending from lower front to upper rear in which the secondary roller 7 moves.

Hence, the behavior of the secondary electrode 118 inside the secondary-electrode receiving groove 202 is substantially the same as the behavior of the primary electrode 117 in the primary-electrode receiving groove 203.

(5) Drive Unit

Figure 10:
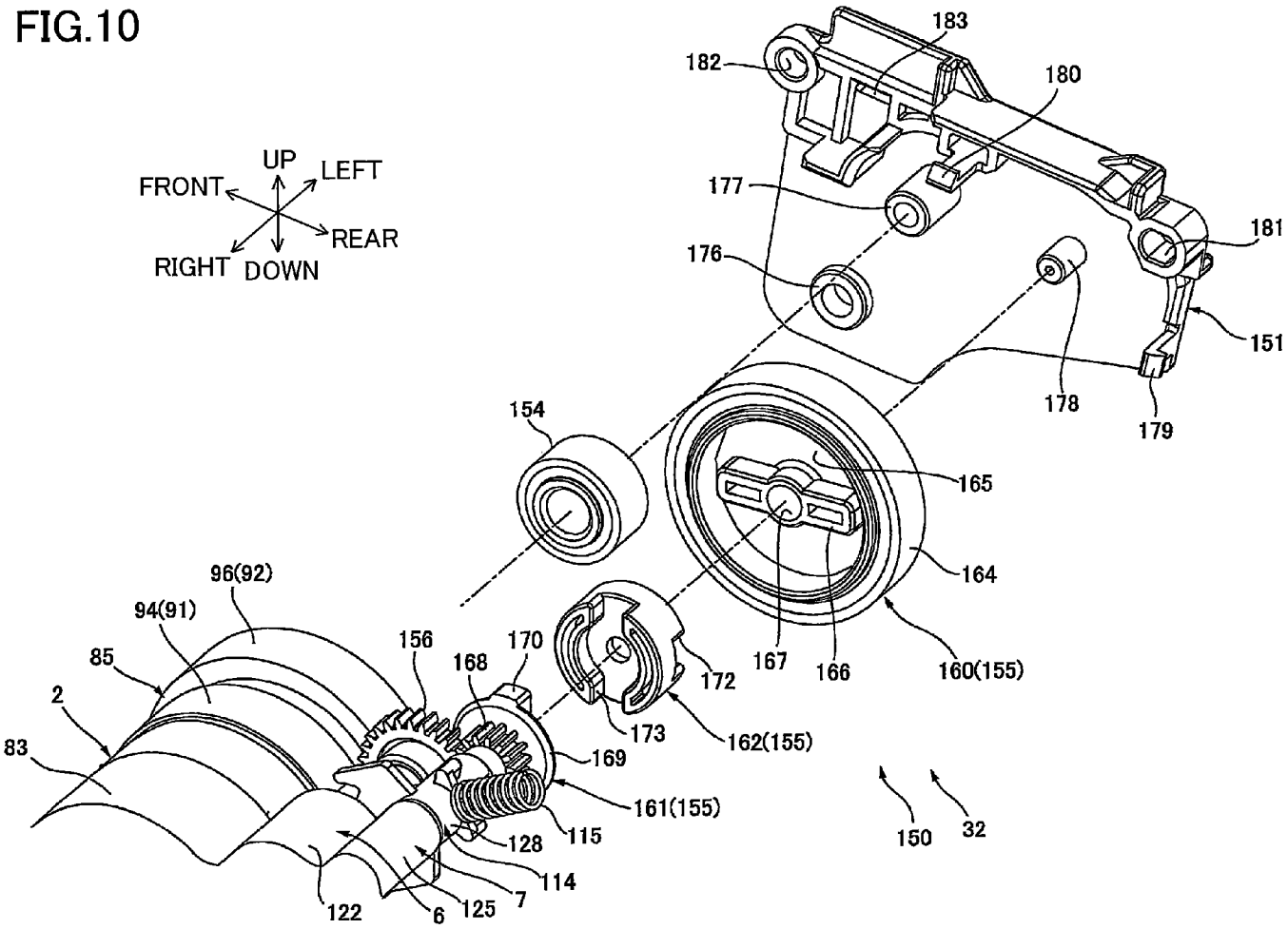
FIG. 10 is an exploded perspective view of the drive unit according to the embodiment shown in FIG. 3 when viewed from a point rightward and rearward thereof, wherein the drum frame is omitted for explanatory purpose.

As shown in FIGS. 3, 9 and 10, the drive unit 32 is disposed on a left-rear end portion of the drum cartridge 1. The drive unit 32 includes a drive transmission mechanism 150, and the gear holder 151 as an example of a contact member of the invention.

(5-1) Drive Transmission Mechanism

The drive transmission mechanism 150 is configured to transmit a drive force to the photosensitive drum 2 and primary roller 6 when the drive force is inputted from a drive source (not shown) provided in the apparatus body 12. In addition to the flange gear 94 and drum gear 96 described above, the drive transmission mechanism 150 includes a first idle gear 154 as an example of a first intermediate gear, the Oldham coupling 155, a primary roller gear 156 as an example of a cleaning gear, and a transfer roller gear 157 shown in FIG. 6.

The flange gear 94 is supported on the left end of the drum body 83 so as to be incapable of rotating relative thereto. As shown in FIG. 12, the flange gear 94 is positioned farther rightward than the second portion 54 constituting the rear left-wall portion 51 of the left base wall 39.

Figure 11A:
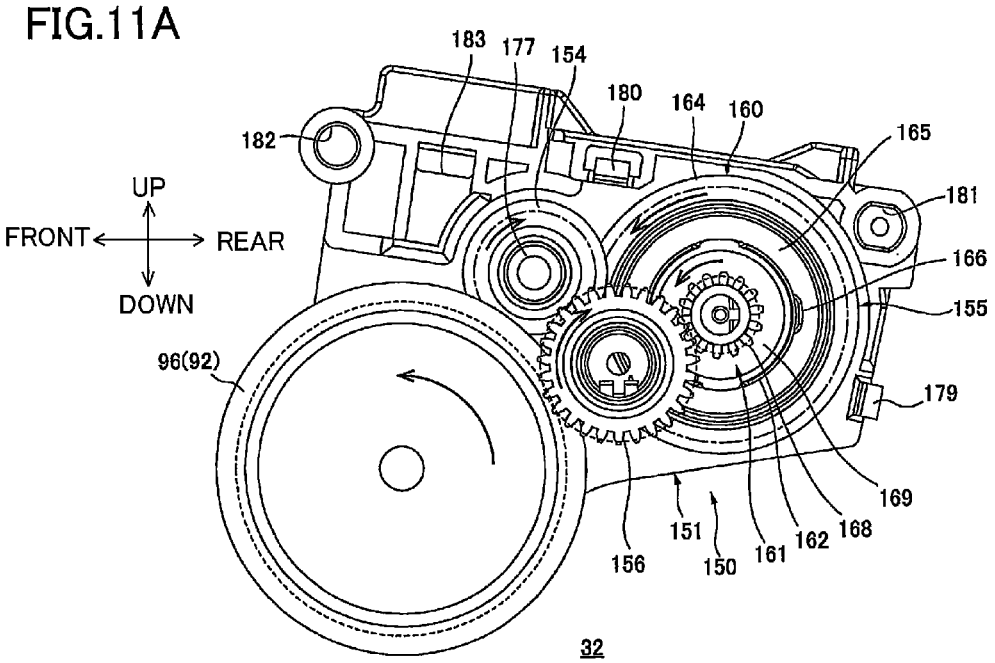
FIG. 11A is a sectional side view of the drive unit according to the embodiment shown in FIG. 3 when viewed from a point rightward thereof.

As shown in FIGS. 6 and 12, the drum gear 96 is fitted into the flange gear 94 so as to be incapable of rotating relative thereto. The drum gear 96 is disposed between the first portion 53 and second portion 54 constituting the rear left-wall portion 51 of the left base wall 39 in the left-right direction. The lower-rear portion of the drum gear 96 is exposed on the outside of the drum frame 31 and is configured to meshingly engage with a drive gear (not shown) provided in the apparatus body 12. This drive gear serves to transmit a drive force from a drive source (not shown) of the apparatus body 12 to the drum gear 96. Hence, the drum gear 96 serves to input the drive force transmitted from the drive source of the apparatus body 12 into the photosensitive drum 2. The drum gear 96 is configured to rotate counterclockwise in a right side view, as shown in FIG. 11A.

Figure 11B:
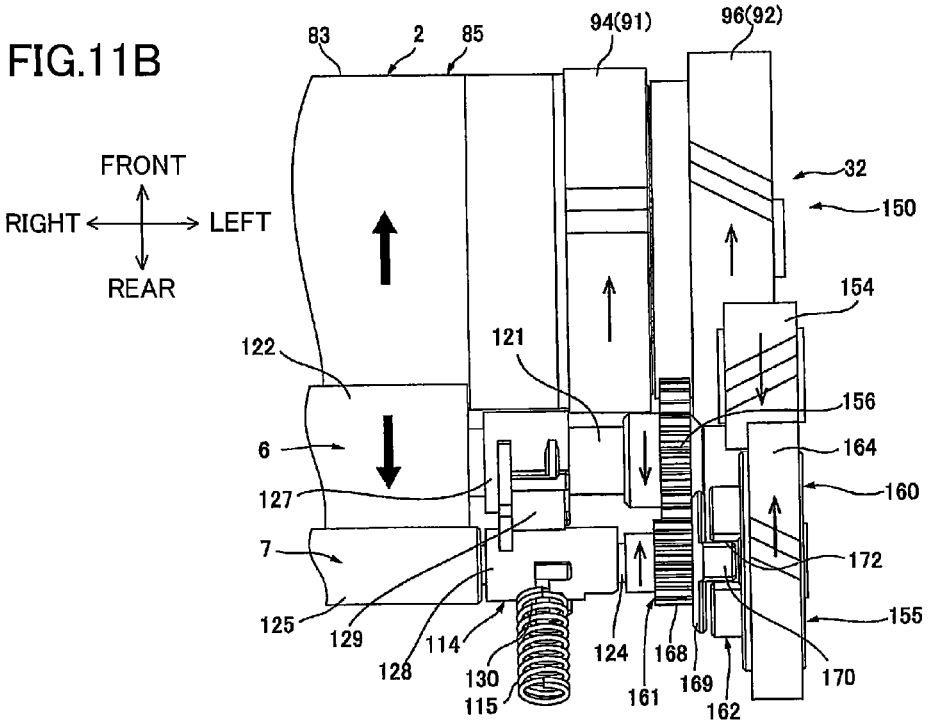
FIG. 11B is a top view showing a drive transmission mechanism of the drive unit according to the embodiment shown in FIG. 11A, wherein the drum frame and a gear holder are omitted for explanatory purpose.

As shown in FIGS. 9 and 10, the first idle gear 154 has a general cylindrical shape that is elongated in the left-right direction. As shown in FIGS. 11A and 11B, the first idle gear 154 has a lower-front edge that is meshingly engaged with an upper-rear edge of the drum gear 96. As shown in FIG. 11A, the first idle gear 154 is configured to rotate clockwise in a right side view.

As shown in FIGS. 9 and 10, the Oldham coupling 155 includes a large-diameter hub 160, a small-diameter hub 161, and a slider 162.

The large-diameter hub 160 constitutes a left portion of the Oldham coupling 155. The large-diameter hub 160 is integrally provided with a second idle gear 164 as an example of a third intermediate gear in the invention, a closure part 165, a large-diameter-hub-side ridge 166, and a through-hole 167.

The second idle gear 164 has a general cylindrical shape that is elongated in the left-right direction. The second idle gear 164 has a diameter smaller than the outer diameter of the drum gear 96 and larger than an outer diameter of the first idle gear 154. As shown in FIGS. 11A and 11B, a front edge of the second idle gear 164 is meshingly engaged with a rear edge of the first idle gear 154. The second idle gear 164 is configured to rotate counterclockwise in a right side view, as shown in FIG. 11A.

As shown in FIGS. 9 and 10, the closure part 165 has a plate-like structure that is generally circular in a side view. The closure part 165 closes the left side of the second idle gear 164.

As shown in FIG. 10, the large-diameter-hub-side ridge 166 protrudes rightward from a right surface of the closure part 165. The large-diameter-hub-side ridge 166 has a general ridge shape that is elongated in a radial direction of the closure part 165.

As shown in FIGS. 9 and 10, the through-hole 167 has a general circular shape in a side view and penetrates an approximate center region of the closure part 165 and large-diameter-hub-side ridge 166 in the left-right direction.

The small-diameter hub 161 constitutes a right portion of the Oldham coupling 155. The small-diameter hub 161 is integrally provided with a secondary roller gear 168 as an example of a second intermediate gear, a disc part 169, and a small-diameter-hub-side ridge 170.

The secondary roller gear 168 constitutes a right portion of the small-diameter hub 161. The secondary roller gear 168 has a general cylindrical shape that is elongated in the left-right direction. The secondary roller gear 168 has a diameter smaller than the diameter of the second idle gear 164. The secondary roller gear 168 is mounted on the left end of the secondary-roller shaft 124 so as to be incapable of rotating relative thereto (see FIG. 11B). Hence, the secondary roller gear 168 serves to input a drive force transmitted from the drive source (not shown) of the apparatus body 12 to the secondary roller 7.

The disc part 169 constitutes an approximate left-right center portion of the small-diameter hub 161. The disc part 169 is arranged adjacent to the left side of the secondary roller gear 168. The disc part 169 has a general disc shape and is arranged coaxially with the secondary roller gear 168. The disc part 169 has a diameter larger than the diameter of the secondary roller gear 168 and smaller than the diameter of the second idle gear 164.

The small-diameter-hub-side ridge 170 constitutes a left portion of the small-diameter hub 161. The small-diameter-hub-side ridge 170 has a general ridge-like shape that is elongated in a radial direction of the disc part 169 and that protrudes leftward from a left surface of the disc part 169.

The slider 162 is disposed between the large-diameter hub 160 and small-diameter hub 161. The slider 162 has a general columnar shape that is elongated in the left-right direction. The slider 162 includes a large-diameter-hub-side groove 172, and a small-diameter-hub-side groove 173.

The large-diameter-hub-side groove 172 is recessed rightward from a left surface of the slider 162 and extends in a radial direction of the same. The width of the large-diameter-hub-side groove 172 is slightly larger than the width of the large-diameter-hub-side ridge 166.

The small-diameter-hub-side groove 173 is recessed leftward from a right surface of the slider 162 and extends in the radial direction of the same. The width of the small-diameter-hub-side groove 173 is slightly larger than the width of the small-diameter-hub-side ridge 170 provided on the small-diameter hub 161. In a left-right projection, the small-diameter-hub-side groove 173 is orthogonal to the large-diameter-hub-side groove 172.

The Oldham coupling 155 is configured when the large-diameter-hub-side groove 172 of the slider 162 receives the large-diameter-hub-side ridge 166 and the small-diameter-hub-side groove 173 of the slider 162 receives the small-diameter-hub-side ridge 170. In other words, the Oldham coupling 155 includes the second idle gear 164 and secondary roller gear 168 as examples of a plurality of gears.

Through this construction, the second idle gear 164 and secondary roller gear 168 can rotate in conjunction with each other, even when their axial centers are offset as the slider 162 slidingly moves relative to the large-diameter-hub-side ridge 166 and small-diameter-hub-side ridge 170. Accordingly, a drive force inputted into the second idle gear 164 is reliably transmitted to the secondary roller gear 168. As shown in FIG. 11A, the secondary roller gear 168 is configured to rotate counterclockwise in a right side view, as does the second idle gear 164.

Note that the Oldham coupling 155 is arranged so as to extend from the interior to the exterior of the first accommodating section 204 provided in the drum frame 31 through the Oldham-coupling connection hole 200 (see FIG. 9).

As shown in FIGS. 10 and 11B, the primary roller gear 156 has a general cylindrical shape that is elongated in the left-right direction. The diameter of the primary roller gear 156 is larger than the diameter of the secondary roller gear 168. The primary roller gear 156 is mounted on the left end of the primary-roller shaft 121 so as to be incapable of rotating relative thereto. As shown in FIGS. 11A and 11B, the primary roller gear 156 is disposed between the drum gear 96 and the Oldham coupling 155 with respect to the direction extending from lower front to upper rear. When viewed in the left-right direction, an upper-front edge of the primary roller gear 156 overlaps a lower-rear edge of the first idle gear 154. An upper-rear edge of the primary roller gear 156 is meshingly engaged with a lower-front edge of the secondary roller gear 168. Hence, the primary roller gear 156 functions to input a drive force transmitted from the drive source (not shown) of the apparatus body 12 to the primary roller 6. The primary roller gear 156 is configured to rotate clockwise in a right side view, as illustrated in FIG. 11A.

As shown in FIG. 6, the transfer roller gear 157 is mounted on a left end of a rotational shaft of the transfer roller 4. The transfer roller gear 157 has a general cylindrical shape that is elongated in the left-right direction. The transfer roller gear 157 has a top edge that is meshingly engaged with a bottom edge of the flange gear 94.

(5-2) Gear Holder

As shown in FIGS. 9 and 10, the gear holder 151 is configured separately from the drum frame 31. The gear holder 151 is provided to the left of the drive transmission mechanism 150. The gear holder 151 has a plate-like structure that is generally rectangular in a side view. The gear holder 151 is formed of a resin material such as acrylonitrile butadiene styrene (ABS) or metal. The material forming the gear holder 151 should be more heat resistant and abrasion resistant to the material forming the second left drum flange 92 (POM) than the material forming the base frame 35 (PS) is. The gear holder 151 includes a drum-shaft support part 176 as an example of a shaft support part of the invention, a first-idle-gear support part 177 as an example of a first protrusion, a large-diameter-hub support part 178 as an example of a second protrusion, the first anchoring pawl 179 as an example of a first engaging pawl, the second anchoring pawl 180 as an example of a second engaging pawl, a first boss hole 181, a second boss hole 182, a wire-cleaner anchoring part 183 as an example of an engaging part.

The drum-shaft support part 176 has a general cylindrical shape that protrudes rightward from a right surface of the gear holder 151 in a lower-front corner thereof. The drum-shaft support part 176 has an outer diameter approximately equal to the diameter of the large-diameter through-hole 56 formed in the left base wall 39 of the base frame 35. The drum-shaft support part 176 has an inner diameter approximately equal to the diameter of the drum shaft 86.

The first-idle-gear support part 177 is disposed in an approximate front-rear center of the gear holder 151 diagonally above and rearward of the drum-shaft support part 176. The first-idle-gear support part 177 has a general columnar shape and protrudes rightward from the right surface of the gear holder 151. The first-idle-gear support part 177 has a diameter approximately equal to the inner diameter of the first idle gear 154.

The large-diameter-hub support part 178 is disposed in an approximate vertical center of the gear holder 151 in a rear portion thereof and is diagonally below and rearward of the first-idle-gear support part 177. The large-diameter-hub support part 178 has a general columnar shape and protrudes rightward from the right surface of the gear holder 151. The large-diameter-hub support part 178 has a diameter approximately equal to the diameter of the through-hole 167 formed in the large-diameter hub 160.

The first anchoring pawl 179 is disposed in a lower-rear corner of the gear holder 151 and is diagonally below and rearward of the large-diameter-hub support part 178. The first anchoring pawl 179 has a hook-like shape, protruding rightward from the right surface of the gear holder 151 and then bending rearward at the right end.

The second anchoring pawl 180 is disposed in an approximate front-rear center of the gear holder 151 at a position diagonally above and rearward of the first-idle-gear support part 177 and diagonally above and forward of the large-diameter-hub support part 178. The second anchoring pawl 180 has a hook-like shape, protruding rightward from the right surface of the gear holder 151 and then bending upward at the right end.

The first boss hole 181 is provided in an upper-rear corner of the gear holder 151 to penetrate therethrough in the left-right direction. The first boss hole 181 is an elongate hole in a side view.

The second boss hole 182 is formed in an upper-front corner of the gear holder 151 to penetrate therethrough in the left-right direction. The second boss hole 182 has a general circular shape in a side view.

The wire-cleaner anchoring part 183 is disposed between the second boss hole 182 and first-idle-gear support part 177 on an upper edge portion of the gear holder 151. The wire-cleaner anchoring part 183 has a general rectangular shape in a side view and penetrates the upper edge portion of the gear holder 151 in the left-right direction.

The gear holder 151 is assembled to the drum frame 31 from the left side so as to cover the drive transmission mechanism 150.

More specifically, the gear holder 151 supports the first idle gear 154 and the large-diameter hub 160 having the second idle gear 164, with the first-idle-gear support part 177 inserted through the first idle gear 154 and the large-diameter-hub support part 178 inserted through the through-hole 167 formed in the large-diameter hub 160 of the Oldham coupling 155.

Further, the drum-shaft support part 176 is inserted into and engaged with the large-diameter through-hole 56 formed in the left base wall 39 of the base frame 35 and receives insertion of the drum shaft 86 of the photosensitive drum 2.

The right endface of the drum-shaft support part 176 is approximately flush with the right surface formed on the first portion 53 of the rear left-wall portion 51. In this way, the right endface of the drum-shaft support part 176 contacts the left endface of the inner cylinder part 99 provided in the second left drum flange 92 of the bearing member 85.

Further, the gear holder 151 is fixed in position relative to the drum frame 31 by the first boss hole 181 receiving the first positioning boss 73 provided on the left cover wall 66 of the cover frame 36 and the second boss hole 182 receiving the second positioning boss 74 provided on the left cover wall 66 of the cover frame 36.

Further, the first anchoring pawl 179 engages with the first anchoring part 57 of the second portion 54 provided on the rear left-wall portion 51 of the left base wall 39 and the second anchoring pawl 180 engages with the second anchoring part 80 of the rear top-wall portion 78 constituting the top cover wall 67 of the cover frame 36. In other words, the gear holder 151 is coupled to both the base frame 35 and cover frame 36.

In this way, the gear holder 151 is mounted on the drum frame 31 and protects the drive transmission mechanism 150.

In a left-right projection, the lower portion of the gear holder 151 overlaps the upper portion of the left base wall 39, as shown in FIG. 6.

When the wire cleaner 103 of the scorotron charger 3 is moved to the left end, the anchoring protrusion 107 of the wire cleaner 103 engages the wire-cleaner anchoring part 183 of the gear holder 151. In this way, the wire cleaner 103 is fixed in position when not being used.

(5-3) Drive Transmission from the Drive Source

As shown in FIGS. 11A and 11B, the drum gear 96 rotates counterclockwise in a right side view when a drive force is transmitted to the drum gear 96 from the drive gear (not shown) of the apparatus body 12. The drum gear 96 then transmits this drive force to the first idle gear 154.

Upon receiving the drive force transmitted from the drum gear 96, the first idle gear 154 rotates clockwise in a right side view. The first idle gear 154 transmits this drive force to the second idle gear 164 of the large-diameter hub 160 provided in the Oldham coupling 155.

When the second idle gear 164 of the large-diameter hub 160 receives the drive force from the first idle gear 154, the large-diameter hub 160 rotates counterclockwise in a right side view in the Oldham coupling 155. The large-diameter hub 160 transmits this drive force to the small-diameter hub 161 through the slider 162.

When the small-diameter hub 161 receives this drive force from the large-diameter hub 160, the secondary roller gear 168 of the small-diameter hub 161 rotates counterclockwise in a right side view together with the second idle gear 164. The secondary roller gear 168 of the small-diameter hub 161 further transmits this drive force to the primary roller gear 156.

Upon receipt of this drive force from the secondary roller gear 168 of the small-diameter hub 161, the primary roller gear 156 rotates clockwise in a right side view.

Through this structure, the photosensitive drum 2 is rotated counterclockwise in a right side view by the drive force inputted into the drum gear 96, and the primary roller 6 rotates clockwise in a right side view by the drive force inputted into the primary roller gear 156. Hence, the photosensitive drum 2 and primary roller 6 are configured to rotate such that their surfaces in the region of contact move in the same direction.

In this way, the rotational speed of the primary roller gear 156 relative to the rotational speed of the drum gear 96 is reduced through the first idle gear 154, second idle gear 164, and secondary roller gear 168 of the drive transmission mechanism 150, producing a speed ratio between the primary roller 6 and photosensitive drum 2 of approximately 0.3. In other words, the first idle gear 154, second idle gear 164, and secondary roller gear 168 constitute a speed reduction mechanism.

Further, since the photosensitive drum 2 is pushed leftward while being rotated due to the biasing force of the compression spring 90, the left endface of the inner cylinder part 99 provided on the photosensitive drum 2 is in pressure contact with and slides against the right endface of the drum-shaft support part 176 of the gear holder 151.

At this time, the threshold value at which the sliding surfaces of the inner cylinder part 99, formed of POM, and the drum-shaft support part 176, formed of ABS, melt or deform due to frictional heating is higher than the threshold value at which the sliding surfaces of the inner cylinder part 99 and the left base wall 39 of the base frame 35, formed of PS, melt or deform due to frictional heating.

4. Detailed Structure of the Apparatus Body

Figure 14A:
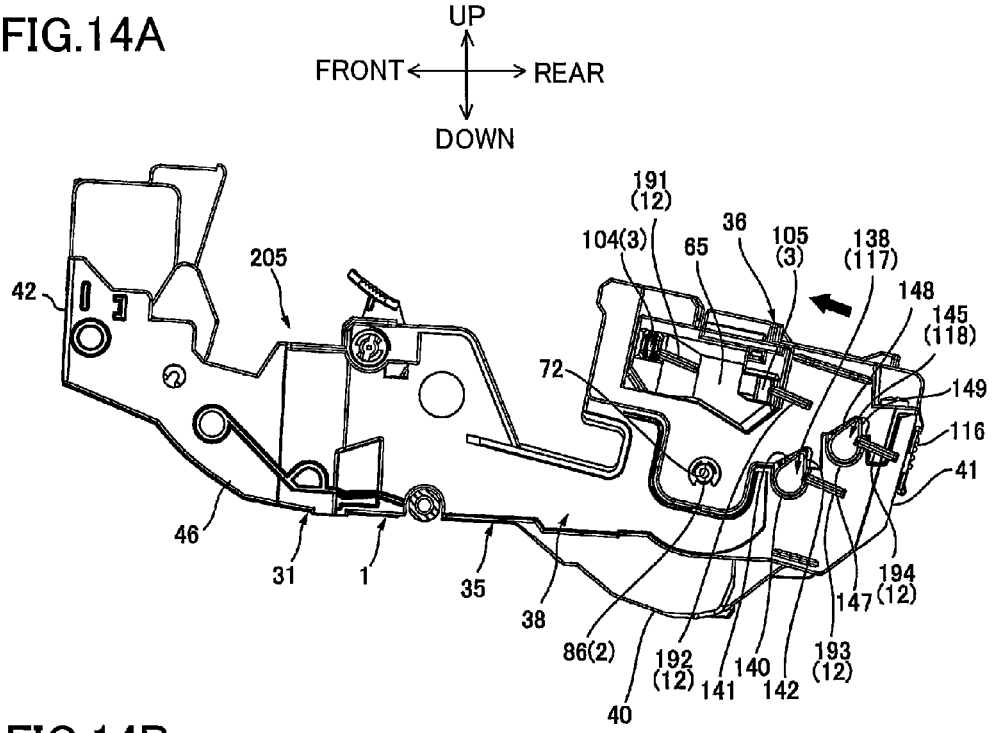
FIG. 14A is an explanatory view explaining how the drum cartridge according to the embodiment shown in FIG. 1 is mounted in the apparatus body of the image forming apparatus after the state of FIG. 13B, wherein the drum cartridge is still in its mid-course of being mounted into the apparatus body.
Figure 14B:
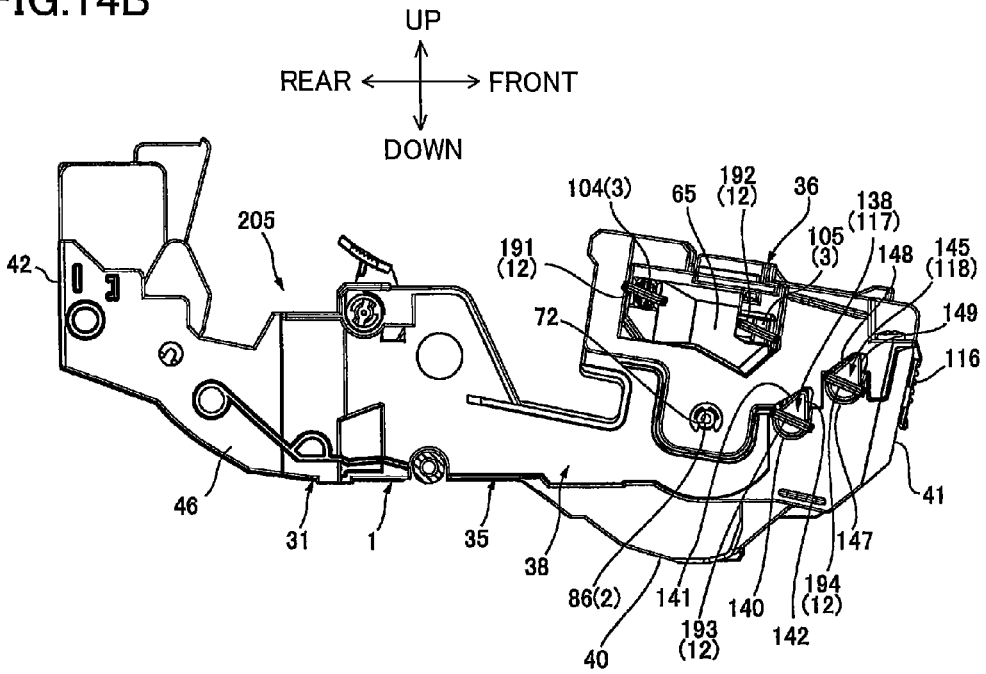
FIG. 14B is an explanatory view explaining how the drum cartridge according to the embodiment shown in FIG. 1 is mounted in the apparatus body of the image forming apparatus after the state of FIG. 14A, wherein the drum cartridge is in a complete mounted state.

As shown in FIG. 14B, the apparatus body 12 includes a first device-side electrode 191, a second device-side electrode 192, the third device-side electrode 193, and the fourth device-side electrode 194.

When the drum cartridge 1 is mounted in the apparatus body 12, the first device-side electrode 191 is positioned to contact the charging electrode 104 in the left-right direction.

When the drum cartridge 1 is mounted in the apparatus body 12, the second device-side electrode 192 is positioned to contact the grid electrode 105 in the left-right direction.

When the drum cartridge 1 is mounted in the apparatus body 12, the third device-side electrode 193 is positioned to contact the contact part 138 of the primary electrode 117 in the left-right direction.

When the drum cartridge 1 is mounted in the apparatus body 12, the fourth device-side electrode 194 is positioned to contact the contact part 145 of the secondary electrode 118 in the left-right direction.

The first device-side electrode 191, second device-side electrode 192, third device-side electrode 193, and fourth device-side electrode 194 are configured to be displaceable in the left-right direction, but are constantly urged leftward. Each of the first device-side electrode 191, second device-side electrode 192, third device-side electrode 193, and fourth device-side electrode 194 is electrically connected to a power supply (not shown) provided in the apparatus body 12.

5. Mounting the Drum Cartridge in the Apparatus Body

Next, operations for mounting the drum cartridge 1 in the apparatus body 12 will be described with reference to FIGS. 13A to 14B.

To mount the drum cartridge 1 in the apparatus body 12, first the operator inserts the developing cartridge 20 into the second accommodating section 205 of the drum cartridge 1 to configure the process cartridge 13, as illustrated in FIG. 2. Next, the operator opens the front cover 17 and inserts the process cartridge 13 into the apparatus body 12 through the access opening 16 in a direction angled downward and rearward.

Figure 13A:
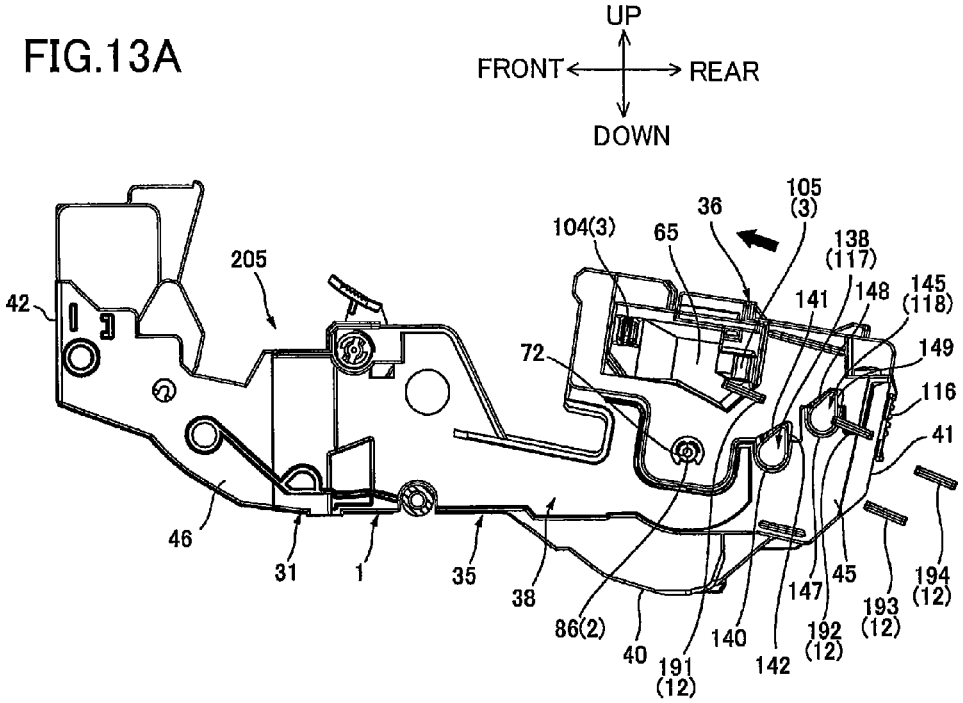
FIG. 13A is an explanatory view explaining how the drum cartridge according to the embodiment shown in FIG. 1 is mounted in an apparatus body of the image forming apparatus, wherein the drum cartridge is in an initial state of being mounted into the apparatus body.

As the operator inserts the process cartridge 13, the first device-side electrode 191 moves diagonally upward and forward relative to the drum cartridge 1 while sliding over the right surface of the right cover wall 65 until arriving at a position beneath the grid electrode 105, as shown in FIG. 13A. Similarly, the second device-side electrode 192 moves diagonally upward and forward relative to the drum cartridge 1 while sliding over the right surfaces of the right base wall 38 and right cover wall 65 until reaching a position to the rear of the curved part 147 constituting the contact part 145 of the secondary electrode 118. The third and fourth device-side electrodes 193 and 194 become positioned to the rear of the drum cartridge 1 but are not in contact with the right base wall 38.

Figure 13B:
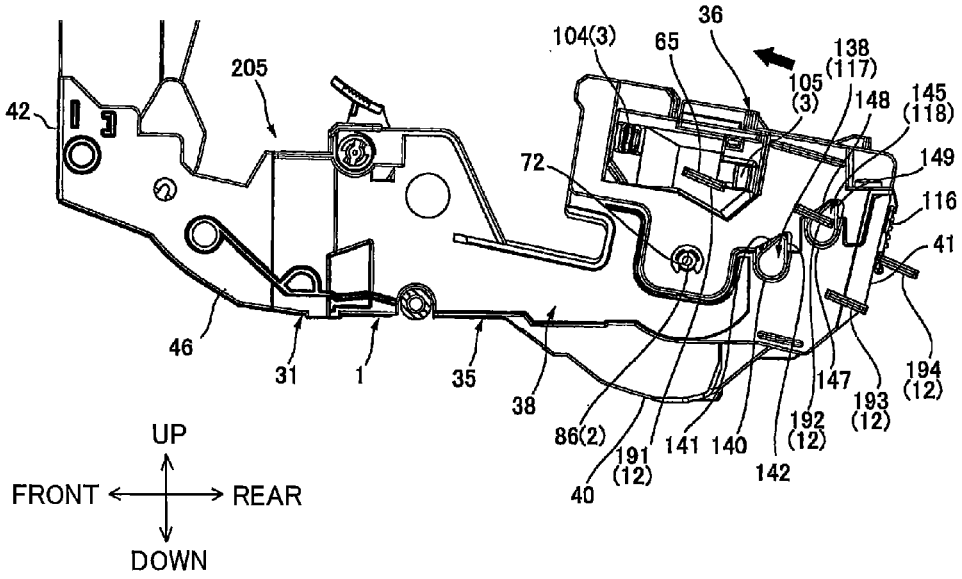
FIG. 13B is an explanatory view explaining how the drum cartridge according to the embodiment shown in FIG. 1 is mounted in the apparatus body of the image forming apparatus after the state of FIG. 13A, wherein the drum cartridge is in its mid-course of being mounted into the apparatus body.

As the operator pushes the process cartridge 13 further into the apparatus body 12, the first device-side electrode 191 moves further upward and forward relative to the drum cartridge 1 while sliding over the right surface of the right cover wall 65 until arriving at a position to the front of the grid electrode 105, as illustrated in FIG. 13B. The second device-side electrode 192 moves upward and forward relative to the drum cartridge 1 while sliding up onto the contact part 145 of the secondary electrode 118 from the curved part 147 side and arrives at position on the right surface of the contact part 145. The third device-side electrode 193 also moves upward and forward relative to the drum cartridge 1 while sliding over the right surface of the right base wall 38 until reaching a position near the lower-rear edge of the right base wall 38. The fourth device-side electrode 194 remains positioned on the rear side of the drum cartridge 1 without contacting the right base wall 38.

As the operator continues to push the process cartridge 13 into the apparatus body 12, the first device-side electrode 191 moves further upward and forward relative to the drum cartridge 1 while sliding over the right surface of the right cover wall 65 until reaching a position to the rear of the charging electrode 104, as shown in FIG. 14A. The second device-side electrode 192 also moves upward and forward relative to the drum cartridge 1, sliding past the contact part 145 of the secondary electrode 118 and over the right surface of the right cover wall 65 until reaching a position to the rear of the grid electrode 105. The third device-side electrode 193 also moves upward and forward relative to the drum cartridge 1 while sliding over the right surface of the right base wall 38 until reaching a position to the rear of the curved part 140 formed on the contact part 138 of the primary electrode 117. The fourth device-side electrode 194 also moves upward and forward relative to the drum cartridge 1 while sliding over the right surfaces of the right base wall 38 and right cover wall 65 until reaching a position to the rear of the curved part 147 formed on the contact part 145 of the secondary electrode 118.

As the operator further continues to push the process cartridge 13 into the apparatus body 12, the first device-side electrode 191 moves further upward and forward relative to the drum cartridge 1 while sliding over the right surface of the right cover wall 65 until coming into contact with the right surface of the charging electrode 104, as illustrated in FIG. 14B. The second device-side electrode 192 also moves upward and forward relative to the drum cartridge 1 while sliding over the right surface of the right cover wall 65 and comes into contact with the right surface of the grid electrode 105. The third device-side electrode 193 also moves upward and forward relative to the drum cartridge 1 while sliding up onto the contact part 138 of the primary electrode 117 from the curved part 140 side and remains in contact with the right surface of the contact part 138. The fourth device-side electrode 194 also moves upward and forward relative to the drum cartridge 1 while sliding up onto the contact part 145 of the secondary electrode 118 from the curved part 147 and remains in contact with the right surface of the contact part 145.

This completes the operations for mounting the process cartridge 13 in the apparatus body 12.

To remove the drum cartridge 1 from the apparatus body 12, the operations for mounting the drum cartridge 1 are performed in reverse. Specifically, the operator opens the front cover 17 shown in FIG. 2 and pulls the process cartridge 13 diagonally upward and forward through the access opening 16. Next, the operator separates the developing cartridge 20 from the process cartridge 13. This completes the operations for removing the drum cartridge 1 from the apparatus body 12.

6. Operational Advantages (1) As shown in FIG. 6, when the drum body 83 is pressed leftward by the pressing member 84, the inner cylinder part 99 of the bearing member 85 contacts the drum-shaft support part 176 of the gear holder 151, thereby suppressing the bearing member 85 from sliding against the left base wall 39 of the drum frame 31. This configuration can suppress wear to the left base wall 39 due to sliding from the bearing member 85 when the photosensitive drum 2 rotates. Thus, stable rotation of the photosensitive drum 2 can be ensured while improving the precision in positioning the photosensitive drum 2 in the left-right direction.

Further, the drum-shaft support part 176 of the gear holder 151 is more heat resistant and abrasion resistant when sliding against the inner cylinder part 99 of the second left drum flange 92 than the left base wall 39 of the base frame 35 is when sliding against the inner cylinder part 99 of the second left drum flange 92. This construction can therefore increase the service life of the drum cartridge 1.

(2) As shown in FIGS. 11A and 11B, the drum cartridge 1 of the embodiment is provided with a plurality of gears for transmitting the drive force inputted from the drive source (not shown) from the photosensitive drum 2 to the primary roller 6. Specifically, the plurality of gears includes the first idle gear 154, second idle gear 164, and secondary roller gear 168. Through this configuration, the speed ratio of the photosensitive drum 2 relative to the primary roller 6 can be set high.

Further, the gear holder 151 can support the first idle gear 154 and the large-diameter hub 160 provided with the second idle gear 164 while contacting the inner cylinder part 99 in the bearing member 85 of the photosensitive drum 2. With this construction, the primary roller 6 can reliably clean the surface of the photosensitive drum 2 while avoiding an increase in the number of parts.

(3) As shown in FIGS. 10 and 11A, the gear holder 151 that contacts the bearing member 85 of the photosensitive drum 2 is provided with the first-idle-gear support part 177 and large-diameter-hub support part 178. This structure can fix the distance between the first idle gear 154 and the second idle gear 164 of the large-diameter hub 160. As a result, the drive force can be reliably transmitted from the first idle gear 154 to the second idle gear 164 and, hence, the drive force can be more reliably transmitted from the drum gear 96 to the primary roller gear 156.

(4) As shown in FIGS. 6 and 10, the drum-shaft support part 176 is inserted into the large-diameter through-hole 56 so that the gear holder 151 is engaged with the drum frame 31, and the drum-shaft support part 176 can support the drum shaft 86 with the photosensitive drum 2. Accordingly, the gear holder 151 can suppress wear to the drum frame 31 due to sliding abrasion by the bearing member 85 of the photosensitive drum 2 and can ensure stable rotation of the photosensitive drum 2 by supporting the drum shaft 86 of the same.

(5) As shown in FIG. 9, the drum frame 31 can be divided into the base frame 35 and cover frame 36 for more easily accommodating the photosensitive drum 2 therein. Further, the gear holder 151 can couple the base frame 35 and cover frame 36 together while suppressing wear on the drum frame 31 caused by sliding of the bearing member 85 of the photosensitive drum 2.

(6) As shown in FIGS. 9 and 10, the base frame 35 and cover frame 36 can easily be coupled together by engaging the first anchoring pawl 179 of the gear holder 151 with the first anchoring part 57 of the base frame 35 and by engaging the second anchoring pawl 180 of the gear holder 151 with the second anchoring part 80 of the cover frame 36, without requiring separate members for coupling the base frame 35 and cover frame 36.

(7) As shown in FIG. 6, the gear holder 151 can be assembled to the left base wall 39 from the left, thereby simplifying its assembly to the drum frame 31. Moreover, at least part of the gear holder 151 overlaps the left base wall 39 in a left-right projection, thereby suppressing an increase in the size of the drum cartridge 1.

(8) As shown in FIGS. 3 and 9, the wire cleaner 103 can be fixed in position by engaging the anchoring protrusion 107 of the wire cleaner 103 with the wire-cleaner anchoring part 183 of the gear holder 151. This arrangement eliminates the need for a separate member to fix the wire cleaner 103 in position, thereby suppressing an increase in the number of parts. Thus, the wire cleaner 103 can be reliably prevented from moving when not being used, while avoiding an increase in the number of parts.

While the invention has been described in detail with reference to the specific embodiment thereof, it would be apparent to those skilled in the art that various changes and modifications may be made therein without departing from the scope of the invention.

What is claimed is:

1. A photosensitive-body cartridge comprising:

a cartridge frame having a first frame and a second frame;

a photosensitive drum accommodated in the first frame of the cartridge frame and covered by the second frame, the photosensitive drum comprising:

a first rotational shaft extending in a first direction, the photosensitive drum being configured to rotate together with the first rotational shaft;

a drum body extending in the first direction and having a first end and a second end in the first direction;

a pressing member provided on the first end of the drum body and applying pressing force to the drum body toward the second end; and a bearing member provided on the second end of the drum body and receiving the first rotational shaft; and a contact member configured to be attached to the cartridge frame and supported by the cartridge frame, the contact member contacting the bearing member in the first direction by the pressing force, the contact member including a first engaging pawl engaging the first frame and a second engaging pawl engaging the second frame to couple the first frame and the second frame.

2. The photosensitive-body cartridge as claimed in claim 1, wherein the bearing member is positioned between the drum body and the contact member in the first direction.

3. The photosensitive-body cartridge as claimed in claim 1, further comprising:

a cleaning roller configured to clean a surface of the photosensitive drum, the cleaning roller having a second rotational shaft parallel to the first rotational shaft and configured to rotate together with the second rotational shaft; and a plurality of gears configured to transmit a drive force inputted therein to the photosensitive drum and the cleaning roller, the contact member supporting at least one of the plurality of gears.

4. The photosensitive-body cartridge as claimed in claim 3, wherein the plurality of gears comprises:

a drum gear provided on the second end of the drum body and configured to rotate together with the first rotational shaft, the drum gear being a part of the bearing member;

a cleaning gear provided on one end of the cleaning roller and configured to rotate together with the second rotational shaft;

a first intermediate gear engaging the drum gear;

a second intermediate gear engaging the cleaning gear; and a third intermediate gear engaging the first intermediate gear and configured to transmit the drive force to the second intermediate gear, and wherein the contact member comprises:

a first protrusion supporting the first intermediate gear; and a second protrusion supporting the third intermediate gear.

5. The photosensitive-body cartridge as claimed in claim 1, wherein the contact member includes a shaft support part engaging the cartridge frame and supporting the first rotational shaft, the first rotational shaft penetrating the shaft support part.

6. The photosensitive-body cartridge as claimed in claim 5, wherein the shaft support part is in pressure contact with the bearing member in the first direction.

7. A photosensitive-body cartridge, comprising:

a cartridge frame having a first frame and a second frame;

a photosensitive drum accommodated in the first frame of the cartridge frame and covered by the second frame, the photosensitive drum comprising:

a first rotational shaft extending, in a first direction the photosensitive drum being configured to rotate together with the first rotational shaft;

a drum body extending in the first direction and having a first end and a second end in the first direction;

a pressing, member provided on the first end of the drum body and applying pressing force to the drum body toward the second end; and a bearing member provided on the second end of the drum body and receiving the first rotational shaft; and a contact member configured to be attached to the cartridge frame and supported by the cartridge frame, the contact member contacting the bearing member in the first direction by the pressing force, the contact member coupling the first frame and the second frame;

wherein the first frame includes a first wall and a second wall opposing each other in the first direction, the photosensitive drum being positioned between the first wall and the second wall in the first direction such that the first wall is near the first end and the second wall is near the second end, the contact member being positioned opposite to the photosensitive drum with respect to the second wall in the first direction and partially overlapping the second wall when projected in the first direction.

8. A photosensitive-body cartridge, comprising:

a cartridge frame;

a photosensitive drum accommodated in the cartridge frame and comprising:

a first rotational shaft extending in a first direction, the photosensitive drum being configured to rotate together with the first rotational shaft;

a drum body extending the first direction and having a first end and a second end in the first direction;

a pressing member provided on the first end of the drum body and apply pressing force to the drum body toward the second end; and bearing member provided on the second end of the drum body and receiving the first rotational shaft; and a contact member configured to be attached to the cartridge frame and supported by cartridge frame, the contact member contacting the bearing member in the first direction bar the pressing force;

wherein the bearing member includes a drum gear configured to rotate together with the first rotational shaft and in pressure contact with the contact member in the first direction, and wherein the contact member is more heat resistant and abrasion resistant to the drum gear than the cartridge frame is to the drum gear.

9. The photosensitive-body cartridge as claimed in claim 8, wherein the contact member is made of acrylonitrile butadiene styrene and the drum gear is made of polyacetal, and wherein the cartridge frame is made of polystyrene.

10. The photosensitive-body cartridge as claimed in claim 1, further comprising:

a charger having a wire and configured to charge the photosensitive drum; and a wire cleaner configured to move in the first direction and to clean the wire, the wire cleaner including an anchoring part, wherein the contact member includes an engaging part configured to engage the anchoring part when the wire cleaner is positioned near the bearing member in the first direction.

* * * * *